US010099479B2

(12) United States Patent
Okuda

(10) Patent No.: US 10,099,479 B2
(45) Date of Patent: Oct. 16, 2018

(54) METHOD FOR MAINTAINING INK JET HEAD

(71) Applicant: Seiko Epson Corporation, Tokyo (JP)

(72) Inventor: Ippei Okuda, Shiojiri (JP)

(73) Assignee: Seiko Epson Corporation (JP)

( * ) Notice: Subject to any disclaimer, the term of this patent is extended or adjusted under 35 U.S.C. 154(b) by 27 days.

(21) Appl. No.: 15/464,667

(22) Filed: Mar. 21, 2017

(65) Prior Publication Data

US 2017/0291421 A1 Oct. 12, 2017

(30) Foreign Application Priority Data

Apr. 12, 2016 (JP) ..... 2016-079502

(51) Int. Cl.
*B41J 2/165* (2006.01)

(52) U.S. Cl.
CPC ..... *B41J 2/16552* (2013.01); *B41J 2/16505* (2013.01)

(58) Field of Classification Search
CPC .... B41J 2/16552; B41J 2/16505; B41J 2/165; B41J 2002/16558; B08B 3/102
See application file for complete search history.

(56) References Cited

FOREIGN PATENT DOCUMENTS

JP 2009-286077 A 12/2009
JP 2010-089404 A 4/2010

*Primary Examiner* — Kristal Feggins
(74) *Attorney, Agent, or Firm* — Harness, Dickey & Pierce, P.L.C.

(57) ABSTRACT

A method for maintaining an ink jet head according to the invention includes at least one of a maintenance step of attaching a maintenance liquid to a nozzle surface of an ink jet head, which ejects a reaction solution including an aggregating agent for aggregating or thickening components of an ink composition, to clean the nozzle surface, and a maintenance step of covering and moisturizing the nozzle surface with a head moisturizing cap supplied with the maintenance liquid, in which the maintenance liquid includes a water-soluble organic solvent having a boiling point of 280° C. or less and water.

14 Claims, 5 Drawing Sheets

METHOD FOR MAINTAINING INK JET HEAD

BACKGROUND

1. Technical Field

The present invention relates to a method for maintaining an ink jet head.

2. Related Art

In the related art, an ink jet recording method for ejecting minute ink droplets from a nozzle of a recording head of an ink jet recording apparatus to record an image on a recording medium is known, and the use thereof in the field of sign printing and the field of high-speed label printing has been the subject of research. In a case where an image is recorded on a low-ink absorbing recording medium (for example, art paper or coated paper) or a non-ink absorbing recording medium (for example, plastic film), the use of an aqueous resin ink composition containing a resin emulsion as ink is being researched from the viewpoint of the global environment, safety for humans, and the like.

Here, in a case of recording on an low (non)-ink absorbing recording medium using an aqueous resin ink composition, a reaction solution may be ejected by an ink jet and used to suppress ink bleeding in some cases. At this time, when a polyvalent metal salt is used as an aggregating agent of the reaction solution to be used, depending on the solubility of the polyvalent metal salt in water, the aggregating agent may precipitate in the nozzle hole of the ink jet head due to drying on the nozzle surface or the like. When the aggregating agent of the reaction solution is precipitated in this manner, since clogging of the nozzle may cause ink ejection failures, it is necessary to clean the nozzle surface.

Therefore, for example, JP-A-2010-89404 discloses an ink jet recording apparatus having a cap which covers and moisturizes a head and a maintenance method using a maintenance liquid. In addition, JP-A-2009-286077 discloses an apparatus for cleaning an ink jet head using a cloth impregnated with a cleaning liquid.

However, in the methods disclosed in JP-A-2010-89404 and JP-A-2009-286077 described above, since no reaction solution is used when recording on the recording medium, there is no disclosure regarding the elimination of ejection failures of the nozzle surface due to the reaction solution. Therefore, in particular, in a case where the reaction solution includes an aggregating agent with low water solubility, drying causes stains left by the dry matter of the aggregating agent to be generated on the nozzle surface, which may lead to ejection failures or the reaction solution dries inside the nozzle when the head is covered with the moisturizing cap, which may lead to ejection failures. However, it is not possible to solve these problems with the methods described above.

SUMMARY

Thus, an advantage of some aspects of the invention is to provide a method for maintaining an ink jet head which is able to eliminate ejection failures of a nozzle surface due to a reaction solution.

The invention can be realized in the following aspects or application examples.

Application Example 1

According to an aspect of the invention, there is provided a method for maintaining an ink jet head, including at least one of attaching a maintenance liquid to a nozzle surface of an ink jet head, which ejects a reaction solution including an aggregating agent for aggregating or thickening components of an ink composition, to clean the nozzle surface, and covering and moisturizing the nozzle surface with a head moisturizing cap supplied with the maintenance liquid, in which the maintenance liquid includes a water-soluble organic solvent having a boiling point of 280° C. or less and water.

According to the application example described above, it is possible to provide a method for maintaining an ink jet head which is able to eliminate ejection failures of a nozzle surface due to a reaction solution by including a water-soluble organic solvent having a boiling point of 280° C. or less and water in a maintenance liquid.

Application Example 2

In the application example described above, the aggregating agent may have a solubility in water of 600 g/L or less.

According to the application example described above, it is possible to eliminate ejection failures of a nozzle surface due to a reaction solution even in a case where the solubility in water is low and the aggregating agent tends to precipitate due to drying of the nozzle surface.

Application Example 3

In the application example described above, at least one of alkanediol or alkylene glycol ether may be provided as the water-soluble organic solvent.

According to the application example described above, the effect of removing the solidified aggregating agent is high and the elimination of ejection failures of the nozzle surface due to the reaction solution is improved.

Application Example 4

In the application example described above, at least one of alkanediol or alkylene glycol ether having 4 or more carbon atoms may be provided as the water-soluble organic solvent.

According to the application example described above, since the alkanediol or alkylene glycol ether having 4 or more carbon atoms has a high moisturizing effect and a high ability to remove the solidified aggregating agent, it is possible to further eliminate ejection failures of the nozzle surface due to the reaction solution.

Application Example 5

In the application example described above, at least one type of water-soluble organic solvent having a normal boiling point of 180° C. or more and 280° C. or less may be provided as the water-soluble organic solvent.

According to the application example described above, a higher moisturizing effect is obtained.

Application Example 6

In the application example described above, the aggregating agent may be at least one selected from the group consisting of a polyvalent metal salt, an organic acid, and a cationic compound.

According to the application example described above, even in a case where the aggregating agent is at least one selected from the group consisting of a polyvalent metal salt, an organic acid, and a cationic compound, it is possible to eliminate ejection failures of the nozzle surface due to the reaction solution.

Application Example 7

In the application example described above, the content of the water-soluble organic solvent in the maintenance liquid may be 3% by mass or more and 49% by mass or less.

According to the application example described above, it is possible to further eliminate ejection failures of the nozzle surface due to the reaction solution.

Application Example 8

In the application example described above, a content of the water-soluble organic solvent having a normal boiling point of more than 280° C. in the maintenance liquid may be 0.5% by mass or less.

According to the application example described above, it is possible to further eliminate ejection failures of the nozzle surface due to the reaction solution.

Application Example 9

In the application example described above, a content of a water-soluble organic solvent having a normal boiling point of more than 280° C. in the ink composition may be 0.5% by mass or less.

According to the application example described above, it is possible to further eliminate ejection failures of the nozzle surface due to the reaction solution.

Application Example 10

In the application example described above, the reaction solution may have a water content of 49% by mass or more.

According to the application example described above, it is possible to further eliminate ejection failures of the nozzle surface due to the reaction solution.

Application Example 11

In the application example described above, an amount of the maintenance liquid supplied to the head moisturizing cap may be 0.1 g/cm$^3$ or more.

According to the application example described above, it is possible to obtain a high moisturizing effect, and to further eliminate ejection failures of the nozzle surface due to the reaction solution.

Application Example 12

In the application example described above, moisturizing time for moisturizing the nozzle surface with the head moisturizing cap may be 30 minutes or more.

According to the application example described above, it is possible to obtain a high moisturizing effect, and to further eliminate ejection failures of the nozzle surface due to the reaction solution.

Application Example 13

In the application example described above, a concentration of the aggregating agent of the reaction solution may be 0.03 mol/kg or more.

According to the application example described above, it is possible to eliminate ejection failures of the nozzle surface due to the reaction solution even in a case where the concentration of the aggregating agent in the reaction solution is high.

Application Example 14

In the application example described above, the method for maintaining an ink jet head may be performed by an ink jet recording apparatus, and ejecting the reaction solution from the ink jet head and ejecting the ink composition from the ink jet head are able to be performed in a state where a surface temperature of a recording medium is 45° C. or less.

According to the application example described above, it is possible to eliminate ejection failures of the nozzle surface due to the reaction solution even in a case where heating is carried out during recording.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description will be given below of preferable embodiments of the invention. The embodiments described below illustrate one example of the invention. In addition, the invention is not limited to the following embodiments, but includes various modifications implemented within a scope not changing the gist of the invention.

A method for maintaining an ink jet head according to the present embodiment includes at least one of a maintenance step of attaching a maintenance liquid to a nozzle surface of an ink jet head, which ejects a reaction solution including an aggregating agent for aggregating or thickening components of an ink composition, to clean the nozzle surface, and a maintenance step of covering and moisturizing the nozzle surface with a head moisturizing cap supplied with a maintenance liquid, in which the maintenance liquid includes a water-soluble organic solvent having a boiling point of 280° C. or less and water.

Description will be given below of the method for maintaining an ink jet head according to the present embodiment by describing the configuration of an ink jet recording apparatus which is provided with an ink jet head which performs maintenance using this maintenance method, the reaction solution, the maintenance liquid, and the ink composition (also referred to below as "ink") in order.

1. Each Configuration

1.1. Ink Jet Recording Apparatus

Description will be given of an example of an ink jet recording apparatus in which the method for maintaining an ink jet head according to the present embodiment is carried out with reference to the drawings. Here, in the present embodiment, an example is shown in which a head moisturizing cap supplied with a maintenance liquid is provided and the nozzle surface is covered and moisturized by the head moisturizing cap; however, the ink jet recording apparatus which is able to be used for the maintenance method according to the present embodiment is not limited to the following aspect.

Figure 1:
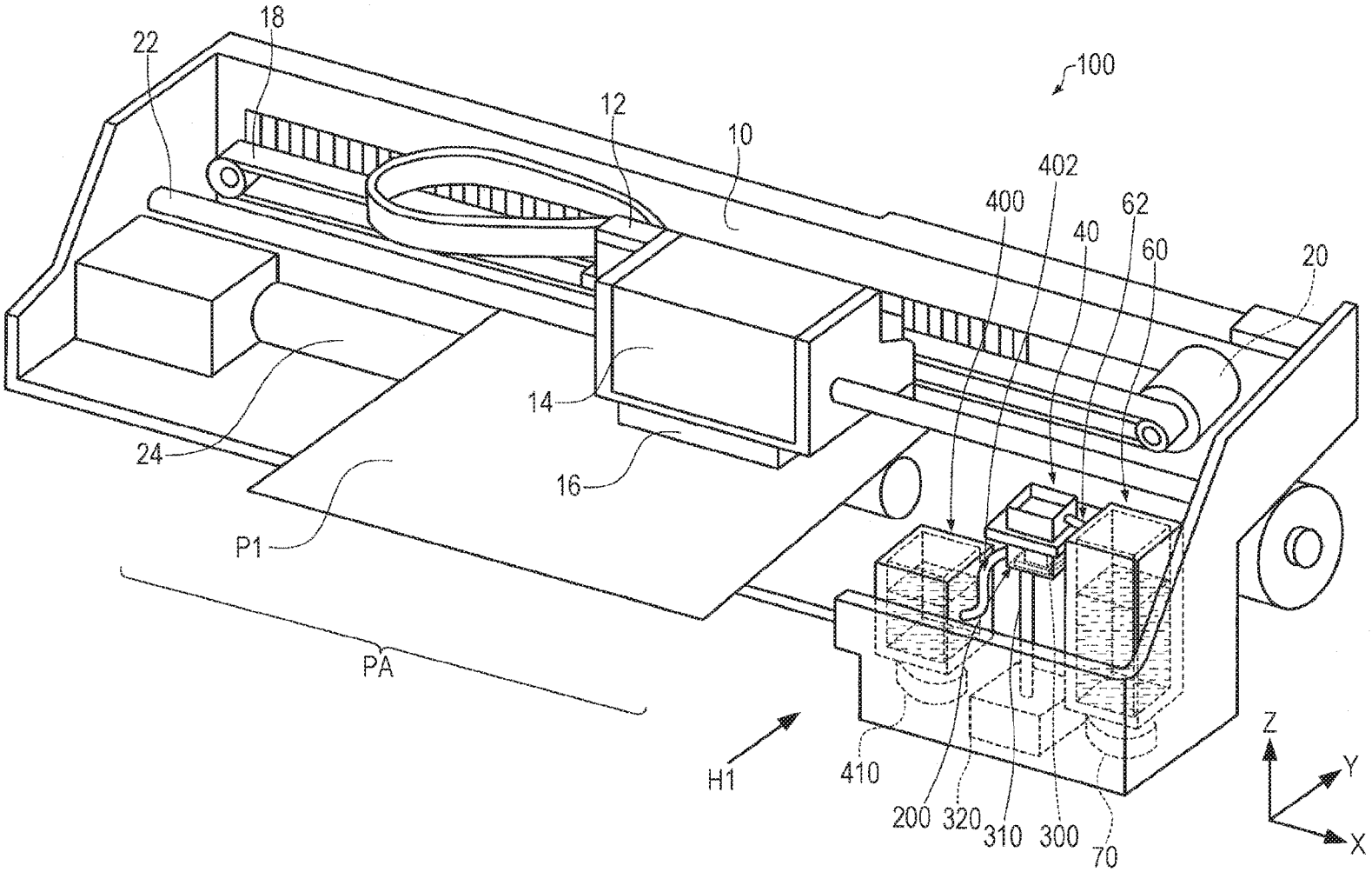
FIG. 1 is a diagram which schematically shows an example of an ink jet recording apparatus which performs a method for maintaining an ink jet head according to the present embodiment.

An example of the ink jet recording apparatus according to the present embodiment is the ink jet recording apparatus shown in FIG. 1. As shown in FIG. 1, an ink jet recording apparatus 100 includes an ink jet head (also simply referred to below as "head") 16, a first cap device (head moisturizing cap) 40, and a first maintenance liquid supply device for supplying the maintenance liquid to the first cap device 40.

The ink jet head 16 is means for attaching ink to a recording medium, and is provided with a nozzle (not shown) for ejecting an ink composition and a reaction solution which includes an aggregating agent for aggregating or thickening components of the ink composition. Examples of methods of ejecting a reaction solution or ink from a nozzle include a method (electrostatic suction method) of applying a strong electric field between a nozzle and an acceleration electrode placed in front of the nozzle, continuously ejecting reaction solution from the nozzle in the form of droplets, and carrying out ejecting corresponding to recording information signals while the liquid droplets of the reaction solution are flying between deflection electrodes; a method of forcibly ejecting droplets of a reaction solution by applying pressure to the reaction solution with a small pump and mechanically vibrating the nozzles using a crystal oscillator or the like; a method (piezo method) in which pressure is applied to a reaction solution by a piezoelectric element according to the timing of a recording information signal and liquid droplets of a reaction solution are ejected and recorded; a method (thermal jet method) in which a resin solution is heated and foamed by a microelectrode in accordance with a recording information signal, and liquid droplets of the reaction solution are ejected and recorded, and the like.

As the ink jet head 16, it is possible to use either a line type ink jet head or a serial type ink jet head, but in the present embodiment a serial type ink jet head is used.

Here, the ink jet recording apparatus provided with a serial type ink jet head means an apparatus which performs recording by performing scanning (passes) a plurality of times for ejecting the ink composition while moving the recording head relative to the recording medium. In a specific example of a serial type recording head, a recording head is mounted on a carriage which moves in the width direction of the recording medium (direction intersecting with the transport direction of the recording medium), and liquid droplets are ejected on the recording medium by moving the recording head in accordance with the movement of a carriage.

On the other hand, an ink jet recording apparatus provided with a line type ink jet head performs recording by performing scanning (a pass) for ejecting the ink composition once while moving the recording head relative to the recording medium. In a specific example of the line type recording head, the recording head is formed to be wider than the width of the recording medium and the recording head ejects droplets on the recording medium without moving.

In the present embodiment, in the example of FIG. 1, the first cap device 40 covers and moisturizes the ink jet head 16. The first maintenance liquid supply device is formed of a first maintenance liquid tank 60, a tube 62, and a first maintenance liquid tank lifting means 70 arranged at a home position H1, and a maintenance liquid which includes a water-soluble organic solvent having a boiling point of 280° C. or less and water is supplied to the first cap device 40.

In FIG. 1, the ink jet recording apparatus 100 has a frame 10. A platen 24 is arranged in the frame 10. In this configuration, a paper feed mechanism (not shown) is provided on the platen 24 and, due to this, printing paper P1 is fed.

The ink jet recording apparatus 100 has a carriage 12. In the configuration in FIG. 1, the carriage 12 is formed to be supported so as to be movable in the longitudinal direction (X axis direction) of the platen 24 via a guide member 22, and reciprocated by a carriage motor 20 via a timing belt 18.

An ink cartridge 14 is mounted on the carriage 12, and an ink jet head 16 is mounted on a lower portion of the carriage 12. The carriage 12 moves along the platen 24 to transport the head 16 so as to reciprocate on the printing paper P1. At this time, the ink or the reaction solution is ejected from the head 16 and the printing process is executed.

In FIG. 1, the width of an area (referred to below as a "printing area") PA where ink or a reaction solution is able to be ejected from the head 16 in the frame 10 is a non-printing area where ink or reaction solution is not to be ejected, and a home position H1 is provided within this non-printing area. The carriage 12 is formed to be movable between the printing area PA and the home position H1.

In addition, in the present embodiment, the ink jet recording apparatus 100 further includes a second cap device 300, a suction apparatus 320, a third cap device 200, and a second maintenance liquid supply device. In FIG. 1, the second cap device 300, the suction apparatus 320, and the third cap device 200 are arranged at the home position H1. In addition, the second maintenance liquid supply device is formed of a second maintenance liquid tank 400, a tube 402, and a second maintenance liquid tank lifting means 410 arranged at the home position H1.

The first cap device 40 is arranged so as to cover the nozzle surface of the head 16 in the power-off state for the following reason. After a printing process or a flushing process (a process of ejecting a predetermined amount of ink from all the nozzles to remove thickened ink or the like separately from the printing process), a suction recovery process (a process of suctioning residual ink in the head 16), or the like, ink droplets and reaction solution droplets may remain attached to the nozzle surface of the head 16 or inside the nozzle. In this case, when the ink attached to the nozzle surface or the like dries, the dried ink may block the nozzle hole and cause ejection failures. Therefore, in order to prevent the ink and the reaction solution attached to the nozzle surface or the like from drying, when the power is off, the head 16 is arranged at the home position H1 and the nozzle surface of the head 16 is covered with the first cap device 40.

A maintenance liquid is stored in the first maintenance liquid tank 60. The first maintenance liquid tank 60 supplies a maintenance liquid for moisturizing the head 16 to the first cap device 40. Note that, the head 16 is moisturized by being covered with the first cap device 40.

On the other hand, the second cap device 300 is arranged so as to cover the nozzle surface of the head 16 during the flushing process and the suction recovery process, and receives the ink discharged from the head 16. Note that, it is sufficient if the ink jet recording apparatus 100 is provided with at least one of the flushing process and the suction recovery process.

The suction apparatus 320 is connected to the second cap device 300 via the suction tube 310, performs a suction recovery process for suctioning and removing the ink and the reaction solution in the head 16, and removes the ink or reaction solution discharged to the second cap device 300. The suction apparatus 320 forcibly ejects and discharges the ink or reaction solution remaining in the head 16 by applying negative pressure to the inside of the second cap device 300 and is able to suction the ink or reaction solution discharged to the second cap device 300.

The third cap device 200 is for moisturizing the second cap device 300. The moisturizing of the second cap device 300 is for the following reason. Unless the second cap device 300 is moisturized, the ink or the reaction solution ejected to the second cap device 300 during a suction recovery process or flushing process may be dried and thickened. Due to this, clogging of a member (sponge or the like) which adsorbs the ink or reaction solution arranged on the second cap device 300, or of the suction tube 310 is generated, which may lead to a decrease in the adsorbing force or suction force of the ink and reaction solution. In particular, when an ink composition having an improved drying property is used for printing on a non-ink-absorbing recording medium such as a plastic film to be described below, the residual ink and the reaction solution in the second cap device 300 may be dried and solidified by being opened to the atmosphere for a short period of several hours during which the ink jet recording apparatus 100 is in operation. Therefore, it is preferable to moisturize the second cap device 300.

A maintenance liquid is stored in the second maintenance liquid tank 400. The second maintenance liquid tank 400 supplies a maintenance liquid for moisturizing the second cap device 300 to the third cap device 200. It is possible for the maintenance liquid used for the second maintenance liquid tank 400 to be the same as the maintenance liquid used for the first maintenance liquid tank 60.

1.1.1. Operation of First Cap Device

Figure 2:
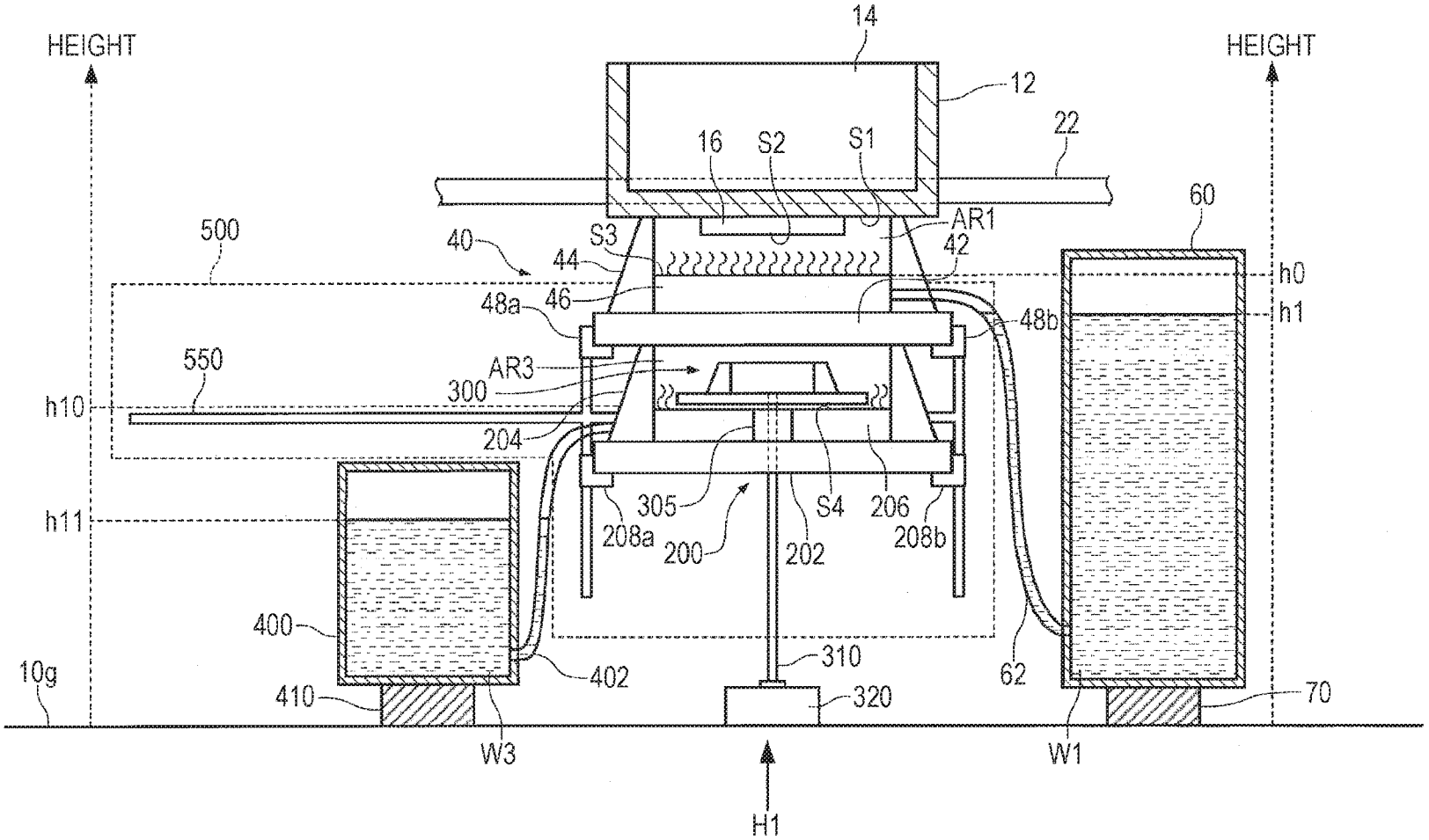
FIG. 2 is an explanatory diagram which shows a detailed configuration in the vicinity of a home position H1 of the ink jet recording apparatus in FIG. 1 in a power-off state.

FIG. 2 is a cross-sectional diagram which shows the configuration in the vicinity of the home position H1 in the power-off state. In a state in which the ink jet recording apparatus 100 is powered off, the carriage 12 is arranged at the home position H1. Note that, even in the power-on state, the carriage 12 and the first cap device 40 are arranged as shown in FIG. 2 in a state in which a printing process or a flushing process is not being executed (standby state).

In FIG. 2, the first maintenance liquid tank 60 and the first cap device 40 are connected by the tube 62. One end of the tube 62 is connected to the inside of the first maintenance liquid tank 60, and stored liquid W1 in the first maintenance liquid tank 60 enters the inside of the tube 62. Here, the water head of the stored liquid W1 in the first maintenance liquid tank 60 is positioned at a height h1 from the frame bottom surface 10*g*. Under the first maintenance liquid tank 60, a first maintenance liquid tank lifting means 70 is arranged. The first maintenance liquid tank lifting means 70 adjusts the position of the first maintenance liquid tank 60 so as to maintain the water head of the stored liquid W1 substantially at the height h1 even when the stored liquid W1 in the first maintenance liquid tank 60 is decreased by being supplied to the first cap device 40. As the first maintenance liquid tank lifting means 70, for example, it is possible to use a spring. In such a case, since the weight of the entire first maintenance liquid tank 60 decreases as the stored liquid W1 decreases, it is possible to maintain the position of the water head at the height h1 by lifting the entire first maintenance liquid tank 60.

In FIG. 2, the first cap device 40 is provided with a cap holder 42, a cap portion 44 arranged on the cap holder and protruding in the Z axis direction, and a sheet-shaped absorbent material 46 arranged on the bottom of a space surrounded by the cap portion 44. The first cap device 40 is supported from below by two support members 48*a* and 48*b*. These two support members 48*a* and 48*b* are connected to a moving mechanism 500 via sliding holes 550 provided in the frame 10 (refer to FIG. 1), and the moving mechanism 500 is able to move the first cap device 40 up, down, left, and right by sliding the two support members 48*a* and 48*b* up, down, left, and right. Note that, the moving mechanism 500 is arranged behind the sliding hole 550 (outside the frame 10).

For example, when the carriage 12 returns from the printing area PA to the home position H1 after the printing finishes and shifts to the standby state, the support members 48*a* and 48*b* are lifted to lift the first cap device 40. By doing so, the cap portion 44 comes into contact with the bottom surface S1 of the carriage 12, and a substantially sealed space AR1 surrounded by the bottom surface S1, the cap portion 44, and the absorbent material 46 is formed. At this time, the maintenance liquid is held on the absorbent material 46, and the maintenance liquid evaporates to humidify the space AR1. In this manner, the cap portion 44 of the first cap device 40 covers and humidifies the nozzle surface S2 and the nozzle (not shown) of the head 16 in a non-contact manner, due to this, it is possible to prevent the residual ink and the reaction solution from drying on the nozzle surface S2 and in the nozzle (not shown) of the head 16 and to suppress an increase in the viscosity of the residual ink and the reaction solution.

Here, in the power-off state (standby state), the height h0 of the upper surface S3 of the absorbent material is higher than the height h1 of the water head of the stored liquid W1 in the maintenance liquid tank 60. Accordingly, in this state, the stored liquid W1 is not supplied as a liquid from the maintenance liquid tank 60 to the first cap device 40. However, the stored liquid W1 which entered the tube 62 evaporates and a very small amount of maintenance liquid is supplied to the absorbent material 46.

It is possible for the cap portion 44 forming the first cap device 40 to be formed of synthetic rubber, for example. One end of the tube 62 penetrates the cap portion 44 and reaches the absorbent material 46. As the absorbent material 46, it is possible to use, for example, an optional member capable of absorbing and holding water such as a urethane or polyvinyl alcohol (PVA) sponge or non-woven fabric. Note that, the first cap device 40 may not be provided with the sheet-shaped absorbent material 46, and the maintenance liquid may be supplied directly into the first cap device 40.

As described above, it is possible to supply the stored liquid W1 to the first cap device 40 using the water head difference d1 between the stored liquid W1 in the first maintenance liquid tank 60 and the absorbent material 46. Accordingly, in the ink jet recording apparatus 100, when the first cap device 40 descends before the carriage 12 moves for the printing process, the upper surface S3 of the absorbent material 46 is configured so as to be positioned lower than the water head of the stored liquid W1 in the first maintenance liquid tank 60. Therefore, a water head difference occurs between the absorbent material 46 and the stored liquid W1 and it is possible to supply the stored liquid W1 to the absorbent material 46 using this water head difference. Due to this, it is possible to supply a large amount of maintenance liquid to the first cap device 40 and to sufficiently humidify the space AR1 inside the first cap device 40.

Note that, the first cap device 40 may have a heating apparatus (not shown) for heating the maintenance liquid supplied into the first cap device 40. Due to this, it is possible to more effectively evaporate the maintenance liquid and to efficiently humidify the space AR1. The position where the heating apparatus is installed is not particularly limited as long as it is possible to sufficiently heat the maintenance liquid supplied to the first cap device 40. As the heating apparatus, it is possible to use an apparatus having a known heating mechanism, for example, it is possible to use an electric heater or the like. In this case, at least a part of the member forming the first cap device 40 is preferably aluminum or an aluminum alloy from the viewpoint of heat resistance and thermal conductivity.

In addition, the first cap device 40 may have an optical sensor (not shown) in order to detect the amount of the maintenance liquid supplied into the first cap device 40. Due to this, it is possible to accurately control the amount of the maintenance liquid in the first cap device 40. The position at which the optical sensor is installed is not particularly limited as long as it is possible to detect the amount of the maintenance liquid in the first cap device 40. Furthermore, appropriately selecting the absorption wavelength of the coloring agent added to the maintenance liquid and the combination of the light-emitting element and the light-receiving element forming the optical sensor also makes it possible to identify not only simply the amount of the maintenance liquid, but also deterioration of the maintenance liquid due to concentration of the coloring agent due to the water component in the maintenance liquid being evaporated, the addition of liquids other than the maintenance liquid (for example, only water), and the like, from the light receiving intensity of the light-receiving element. As the optical sensor, it is possible to use a known optical sensor and, for example, it is possible to use a reflection type photosensor, a regression reflection type photosensor, a separation type photosensor, or the like.

1.1.2. Operation of Second and Third Cap Device

In FIG. 2, the third cap device 200 has substantially the same configuration as the first cap device 40. That is, the third cap device 200 is provided with a cap holder 202, a cap portion 204, and an absorbent material 206. A support member 305 is arranged at the central portion of the absorbent material 206, and a second cap device 300 is arranged on the upper portion of the support member 305. The third cap device 200 does not need to have the sheet-shaped absorbent material 206, and may directly supply the maintenance liquid to the inside of the third cap device 200.

The configuration of the second cap device 300 is different from that of the first cap device 40 in not being connected to the maintenance liquid tank and being connected to the suction apparatus 320, and the configuration is the same in other respects.

In FIG. 2, in the same manner as the first cap device 40, the third cap device 200 is supported from below by two support members 208*a* and 208*b*. These two support members 208*a* and 208*b* are connected to the moving mechanism 500 via sliding holes 550. The moving mechanism 500 is able to vertically move the third cap device 200 by vertically sliding the two support members 208*a* and 208*b*.

In the second maintenance liquid tank 400, a maintenance liquid as a moisturizing liquid is stored as a stored liquid W3. In the same manner as the first maintenance liquid tank 60, the second maintenance liquid tank 400 is connected to the third cap device 200 (the absorbent material 206) via the tube 402 and, in addition, the second maintenance liquid tank lifting means 410 is arranged on the lower side of the second maintenance liquid tank 400. In the same manner as the first maintenance liquid tank lifting means 70, the second maintenance liquid tank lifting means 410 is able to adjust the position of the second maintenance liquid tank 400 such that the water head of the stored water W3 in the second maintenance liquid tank 400 is maintained substantially at a height h11.

In the power-off state and the standby state, the third cap device 200 comes into contact with the bottom surface of the first cap device 40 (the bottom surface of the cap holder 42) through the cap portion 204. Accordingly, a substantially sealed space AR3 surrounded by the bottom surface of the cap holder 42, the cap portion 204, and the absorbent material 206 is formed. Then, the space AR3 is humidified by the moisture absorbed by the absorbent material 206 evaporating and it is possible to suppress drying of the ink ejected into the second cap device 300. Here, in the power-off state (standby state), since the height h10 of the upper surface S4 of the absorbent material 206 is higher than the height h11 of the water head of the stored water W3 in the second maintenance liquid tank 400, the stored water W3 is not supplied from the second maintenance liquid tank 400 to the absorbent material 206.

In addition, the third cap device 200 may have a heating apparatus for heating the maintenance liquid supplied to the inside of the third cap device 200. Due to this, it is possible to evaporate the maintenance liquid more effectively, and to efficiently humidify the space AR3. The position where the heating apparatus is installed is not particularly limited as long as it is possible to sufficiently heat the maintenance liquid supplied to the third cap device 200. Note that, as the heating apparatus used for the third cap device 200, it is possible to use the same apparatus as for the first cap device 40. In such a case, at least a part of the member forming the third cap device 200 is preferably aluminum or an aluminum alloy from the viewpoint of heat resistance and thermal conductivity.

In addition, the third cap device 200 may have an optical sensor in order to detect the amount of the maintenance liquid supplied into the third cap device 200. Due to this, it is possible to accurately control the amount of the maintenance liquid in the third cap device 200. The position at which the optical sensor is installed is not particularly limited as long as it is possible to detect the amount of the maintenance liquid in the third cap device 200. Furthermore, appropriately selecting the absorption wavelength of the coloring agent added to the maintenance liquid and the combination of the light-emitting element and the light-receiving element forming the optical sensor, also makes it possible to identify not only simply the amount of the maintenance liquid, but also deterioration of the maintenance liquid due to concentration of the coloring agent due to the water component in the maintenance liquid being evaporated, the addition of liquids other than the maintenance liquid (for example, only water), and the like, from the light receiving intensity of the light-receiving element. As the optical sensor, it is possible to use a known optical sensor and, for example, it is possible to use a reflection type photosensor, a regression reflection type photosensor, a separation type photosensor, or the like.

Figure 3:
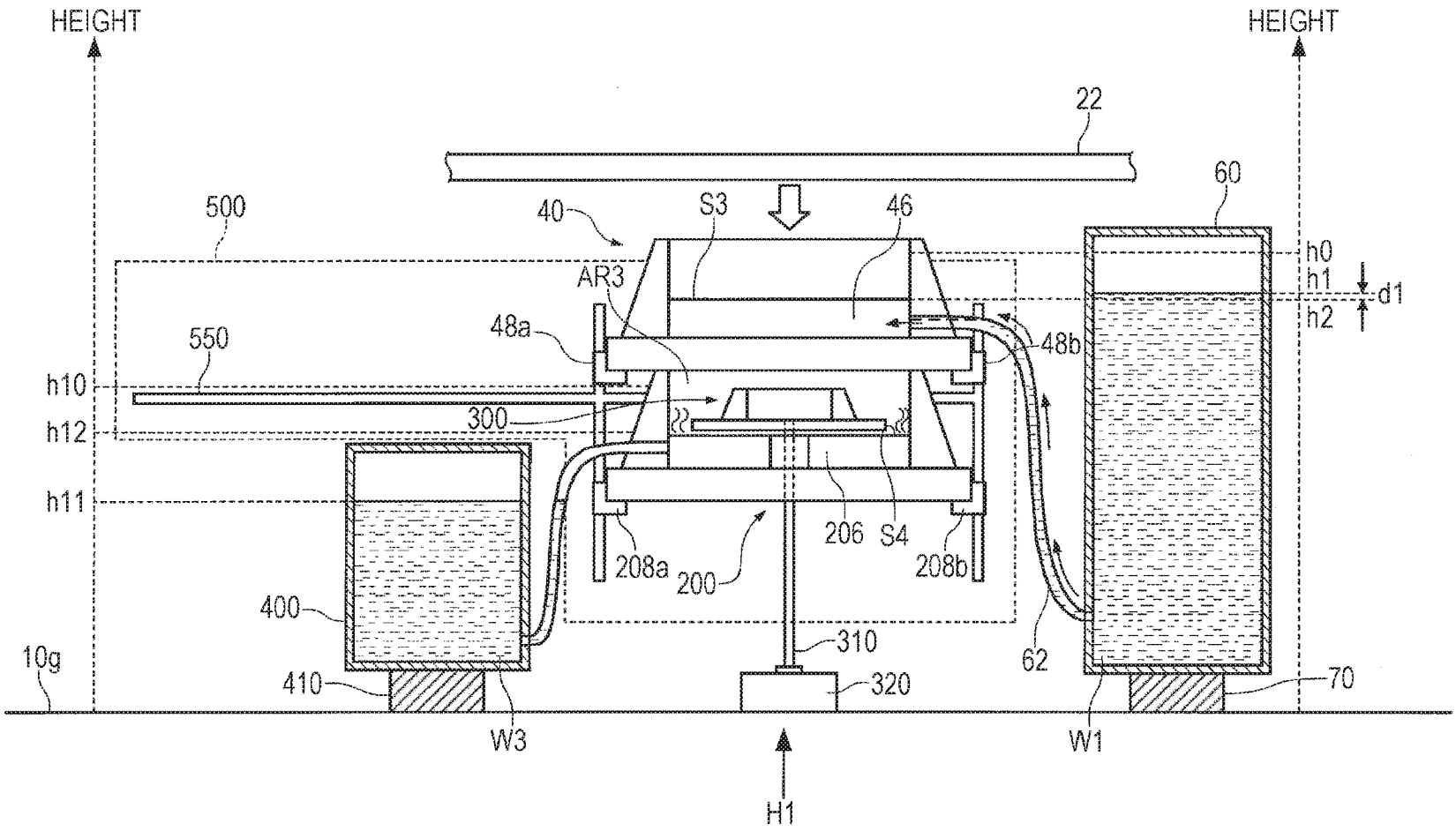
FIG. 3 is an explanatory diagram which shows a detailed configuration in the vicinity of the home position H1 during execution of a printing process of the ink jet recording apparatus in FIG. 1.

FIG. 3 is an explanatory diagram which shows a detailed configuration in the vicinity of the home position H1 during execution of a printing process. At the start of the printing process, the moving mechanism 500 lowers the first cap device 40 and the third cap device 200 simultaneously at the same speed. As a result, the space AR3 is not opened, and the humidity in the space AR3 is preserved. At this time, in the moving mechanism 500, the first cap device 40 (and the third cap device 200) is lowered such that the height h2 of the upper surface S3 of the absorbent material 46 of the first cap device 40 is lower than the height h1 of the water head of the stored liquid W1 in the first maintenance liquid tank 60. Therefore, a water head difference d1 (h1−h2) is generated between the absorbent material 46 and the water head of the stored liquid W1 in the first maintenance liquid tank 60, and the stored liquid W1 is supplied from the first maintenance liquid tank 60 to the first cap device 40.

At this time, in the third cap device 200, the position of the upper surface S4 of the absorbent material 206 is set to a height h12 higher than the height h11 of the water head of the stored liquid W3 in the second maintenance liquid tank 400. Accordingly, the stored liquid W3 is not supplied from the second maintenance liquid tank 400 to the third cap device 200.

Figure 4:
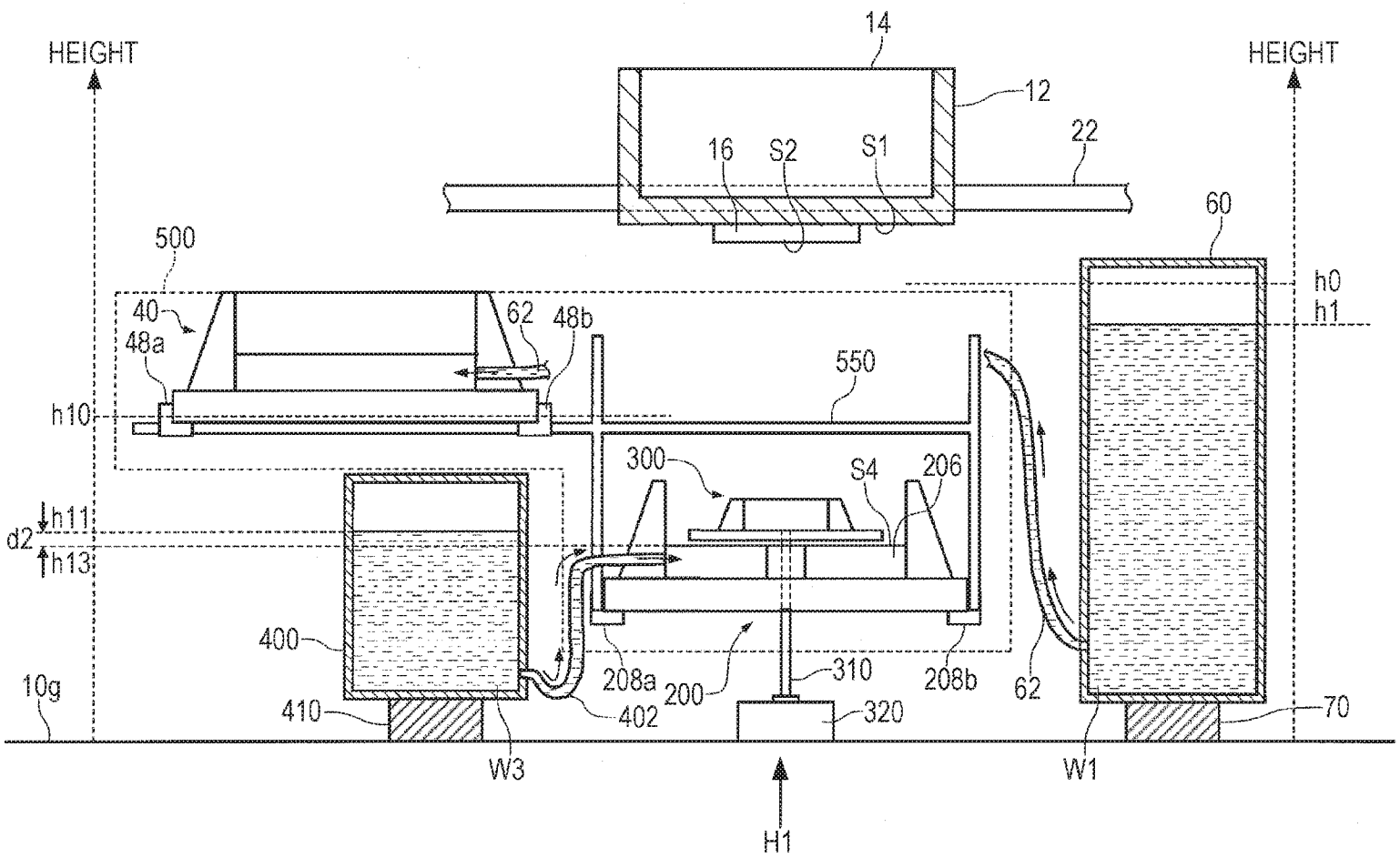
FIG. 4 is an explanatory diagram which shows a detailed configuration in the vicinity of the home position H1 during execution of a suction recovery process of the ink jet recording apparatus in FIG. 1.

FIG. 4 is an explanatory diagram which shows a detailed configuration in the vicinity of the home position H1 during execution of the suction recovery process. When shifting from the standby state (FIG. 2) to the suction recovery process, the moving mechanism 500 first lowers the first cap device 40 and the third cap device 200 slightly. Thereafter, the moving mechanism 500 moves the first cap device 40 to the left from the home position H1, and further lowers the third cap device 200 at the home position H1. At this time, the moving mechanism 500 lowers the third cap device 200 such that the height h13 of the upper surface S4 of the absorbent material 206 is lower than the height h11 of the water head of the stored liquid W3 in the second maintenance liquid tank 400. By doing so, a water head difference d2 (h11−h13) occurs between the absorbent material 206 and the stored liquid W3 in the second maintenance liquid tank 400, and the stored liquid W3 is supplied from the second maintenance liquid tank 400 to the third cap device 200 (absorbent material 206).

Figure 5:
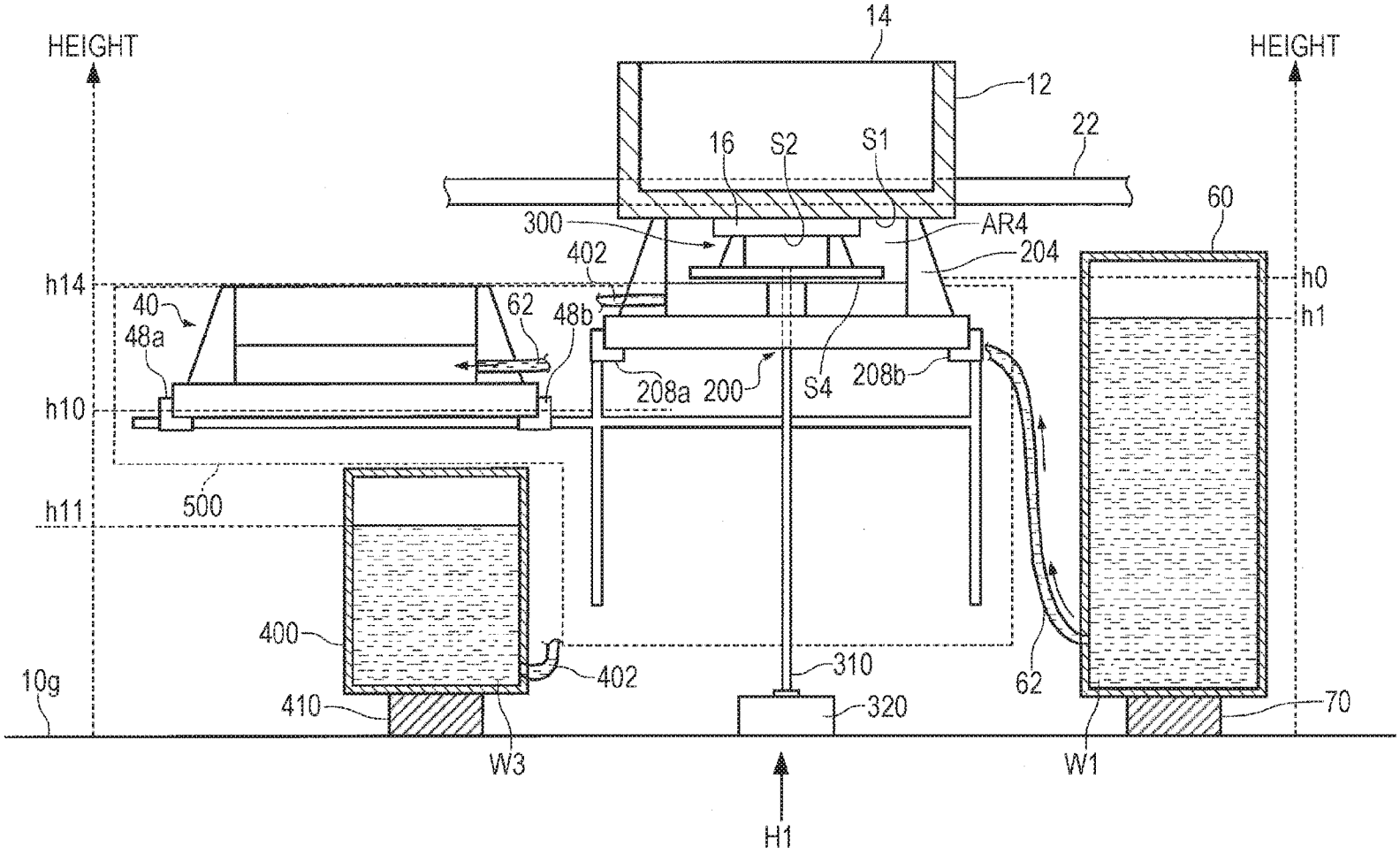
FIG. 5 is an explanatory diagram which shows a detailed configuration in the vicinity of the home position H1 during execution of a suction recovery process of the ink jet recording apparatus in FIG. 1.

FIG. 5 is an explanatory diagram which shows the detailed configuration in the vicinity of the home position H1 during execution of the suction recovery process. Note that, FIG. 5 shows a state temporally later than the state shown in FIG. 4. The moving mechanism 500 lowers the third cap device 200 to the position shown in FIG. 4 and supplies the stored liquid W3 to the absorbent material 206, and then lifts the third cap device 200 after that. Then, when the cap portion 204 of the third cap device 200 contacts the bottom surface S1 of the carriage 12, the moving mechanism 500 stops lifting the third cap device 200. At this time, a substantially sealed space AR4 surrounded by the bottom surface S1 of the carriage 12, the cap portion 204, and the absorbent material 206 is formed. Then, the suction apparatus 320 suctions the residual ink or the reaction solution from the nozzle (not shown) of the head 16 by applying negative pressure to the inside of the second cap device 300. At this time, the height h14 of the upper surface S4 of the absorbent material 206 is formed so as to be higher than the height h11 of the water head of the stored liquid W3 in the second maintenance liquid tank 400, and the stored liquid W3 is not supplied to the absorbent material 206.

As described above, in addition to the power-off state (standby state), the second cap device 300 is covered and moisturized by the third cap device 200 even during execution of the printing process. Accordingly, it is possible to suppress the drying of the ink and the reaction solution ejected into the second cap device 300 in the suction recovery process and to suppress a decrease in the adsorption capability of the ink in the second cap device 300 and a decrease in the suction power of the nozzle. In addition, since it is possible to supply the stored liquid W3 to the third cap device 200 using the water head difference d2 between the stored liquid W3 in the second maintenance liquid tank 400 and the absorbent material 206, it is possible to sufficiently humidify the spaces AR3 and AR4 inside the third cap device 200.

Note that, in the configuration of ink jet recording apparatus 100, a plurality of ink jet heads may be provided, and the second cap device may be provided so as to correspond to each ink jet head. In this case, in the suction recovery operation, since it is possible to suction the ink and the reaction solution in each of the ink jet heads by the cap portion, compared with a case of a cap which collectively covers and suctions a plurality of ink jet heads, the volume in the cap is reduced and the suction efficiency is excellent.

1.1.3. Other

In the embodiment described above, a configuration is provided in which a head moisturizing cap which supplies a maintenance liquid is provided and the nozzle surface is covered and moisturized by the head moisturizing cap; however, as a maintenance step, in a case where a maintenance liquid is attached to the nozzle surface to clean the nozzle surface, for example, the following configuration is adopted.

For example, a configuration may be adopted in which a head cleaning apparatus, which is provided with wiping means for wiping the nozzle surface of the head 16 using an absorbent body impregnated with the maintenance liquid, is incorporated at the home position H1 of the ink jet recording apparatus 100. In this case, it is possible to use a known apparatus as the head cleaning apparatus, and the wiping means is, for example, configured to be provided with an absorbent body on the surface opposing the nozzle surface.

The absorbent body is used for cleaning by wiping the nozzle surface of the head 16 in a state of holding the maintenance liquid and absorbing or adsorbing solidified substances such as those derived from the aggregating agent attached to the nozzle and the nozzle surface. The absorbent body of the wiping means is not particularly limited as long as it is liquid absorbent, and examples thereof include fabric (woven fabric, knitted fabric, nonwoven fabric, and the like), sponges, pulp, and the like. Among these, cloth is preferable. The material forming the fabric is not particularly limited, but examples thereof include materials made of cupra, polyester, polyethylene, polypropylene, lyocell, rayon or the like. At this time, it is preferable to select a material which is not easily deteriorated by the impregnating solution.

In addition, in the case of cleaning the nozzle surface by attaching the maintenance liquid as a maintenance step, in addition to the method of wiping the nozzle surface with the absorbent body impregnated with the maintenance liquid as described above, the method may be a method of spraying the maintenance liquid on the nozzle surface by spraying means or a method of wiping the nozzle surface to which the maintenance liquid is attached by spraying means using wiping means.

1.2. Reaction Solution

Next, description will be given of the reaction solution. The reaction solution used in the present embodiment includes an aggregating agent for aggregating or thickening the components of the ink composition. Detailed description will be given below of components which are included and components which may be included in the reaction solution used in the present embodiment.

1.2.1. Aggregating Agent

The reaction solution used in the present embodiment contains an aggregating agent which acts on the resin included in the ink composition to aggregate or thicken the components of the ink composition. By including the aggregating agent in the reaction solution, the aggregating agent and the resin included in the ink composition react quickly in the recording step described below. By doing so, the dispersion state of the coloring material and the resin in the ink composition is disrupted, and the coloring material and the resin aggregate. Since this aggregate inhibits permeation of the coloring material into the recording medium, it is considered that the aggregate will be excellent in terms of improving the image quality of the recorded image.

Examples of aggregating agents include polyvalent metal salt, organic acid, and cationic compounds (cationic resin, cationic surfactant, and the like). These aggregating agents may be used singly or in a combination of two or more types. Among these aggregating agents, it is preferable to use at least one aggregating agent selected from the group consisting of polyvalent metal salt and organic acid from the viewpoint of excellent reactivity with the resin included in the ink composition.

The polyvalent metal salt is a water-soluble compound which is formed of divalent or higher polyvalent metal ions and anions bonded to these polyvalent metal ions. Specific examples of polyvalent metal ions include divalent metal ions such as $Ca^{2+}$, $Cu^{2+}$, $Ni^{2+}$, $Mg^{2+}$, $Zn^{2+}$, $Ba^{2+}$, and the like; and trivalent metal ions such as $Al^{3+}$, $Fe^{3+}$, and $Cr^{3+}$. Examples of anions include $Cl^-$, $I^-$, $Br^-$, $SO_4^{2-}$, $ClO^{3-}$, $NO^{3-}$, and $HCOO^-$, $CH_3COO^-$, and the like. Among these polyvalent metal salts, calcium salts and magnesium salts are preferable from the viewpoints of stability of the reaction solution and reactivity as an aggregating agent.

Preferable examples of organic acids include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyrone carboxylic acid, pyrrole carboxylic acid, furancarboxylic acid, pyridine carboxylic acid, coumalic acid, thiophene carboxylic acid, nicotinic acid, derivatives of these compounds, or salts thereof. One type of organic acid may be used singly, or two or more types may be used in combination.

Examples of cationic resins include a cationic urethane resin, a cationic olefin resin, a cationic allylamine resin, and the like.

As the cationic urethane resin, it is possible to appropriately select and use known resins. As the cationic urethane resin, it is possible to use commercially available products and, for example, it is possible to use Hydran CP-7010, CP-7020, CP-7030, CP-7040, CP-7050, CP-7060, CP-7610 (trade name, manufactured by DIC Corporation), Superflex 600, 610, 620, 630, 640, 650 (trade name, manufactured by DKS Co. Ltd.), urethane emulsion WBR-2120C, WBR-2122C (trade name, manufactured by Taisei Fine Chemical Co., Ltd.) and the like.

The cationic olefin resin has an olefin such as ethylene, propylene or the like in the structural skeleton thereof, and it is possible to appropriately select and use known resins. In addition, the cationic olefin resin may be in an emulsion state dispersed in a solvent which includes water, an organic solvent, or the like. As the cationic olefin resin, it is possible to use commercially available products and examples thereof include Arrow Base CB-1200, CD-1200 (trade name, manufactured by Unitika Ltd.), and the like.

As the cationic allylamine resin, it is possible to appropriately select and use known resins and examples thereof include polyallylamine hydrochloride, polyallylamine amide sulfate, allylamine hydrochloride.diallylamine hydrochloride copolymer, allylamine acetate.diallylamine acetate copolymer, allylamine hydrochloride dimethylallylamine hydrochloride copolymer, allylamine dimethylallylamine copolymer, polydiallylamine hydrochloride, polymethyldiallylamine hydrochloride, polymethyldiallylamine amide sulfate, polymethyldiallylamine acetate, polydiallyldimethylammonium chloride, diallylamine acetate.sulfur dioxide copolymer, diallylmethylethylammonium ethyl sulfate.sulfur dioxide copolymer, methyldiallylamine hydrochloride.sulfur dioxide copolymer, diallyldimethylammonium chloride.sulfur dioxide copolymer, diallyldimethylammonium chloride.acrylamide copolymer, and the like. It is possible to use commercial products as the cationic allylamine resins, for example, it is possible to use PAA-HCL-01, PAA-HCL-03, PAA-HCL-05, PAA-HCL-3L, PAA-HCL-10L, PAA-H-HCL, PAA-SA, PAA-01, PAA-03, PAA-05, PAA-08, PAA-15, PAA-15C, PAA-25, PAA-H-10C, PAA-D11-HCL, PAA-D41-HCL, PAA-D19-HCL, PAS-21CL, PAS-M-1L, PAS-M-1, PAS-22SA, PAS-M-1A, PAS-H-1L, PAS-H-5L, PAS-H-10L, PAS-92, PAS-92A, PAS-J-81L, and PAS-J-81 (trade names, manufactured by Nittobo Medical Co., Ltd.), Himo Neo-600, Himoloc Q-101, Q-311, Q-501, Himax SC-505, and SC-505 (trade names, manufactured by Hymo Co., Ltd), and the like.

Examples of cationic surfactants include primary, secondary and tertiary amine salt type compounds, alkylamine salts, dialkylamine salts, aliphatic amine salts, benzalkonium salts, quaternary ammonium salts, quaternary alkyl ammonium salts, alkyl pyridinium salts, sulfonium salts, phosphonium salts, onium salts, imidazolinium salts, and the like. Specific examples of cationic surfactants include hydrochlorides and acetates of laurylamine, palm amine and rosinamine, lauryltrimethylammonium chloride, cetyltrimethylammonium chloride, benzyltributylammonium chloride, benzalkonium chloride, dimethylethyl lauryl ammonium ethyl sulfate, dimethyl ethyl octyl ammonium ethyl sulfate, trimethyl lauryl ammonium hydrochloride, cetyl pyridinium chloride, cetyl pyridinium bromide, dihydroxyethyl lauryl amine, decyl dimethyl benzyl ammonium chloride, dodecyl dimethyl benzyl ammonium chloride, tetradecyl dimethyl ammonium chloride, hexadecyl dimethyl ammonium chloride, octadecyl dimethyl ammonium chloride, and the like.

The aggregating agent may have a solubility in water of 600 g/L or less. In the present embodiment, since maintenance of the ink jet head is performed using the maintenance liquid described below, even in a case where the solubility in water is low and the aggregating agent tends to precipitate due to drying of the nozzle surface, it is possible to eliminate ejection failures of the nozzle surface due to the reaction solution. Note that, even when the solubility in water is 500 g/L or less, it is possible to obtain the effect of the invention, and even when the solubility in water is 400 g/L or less, or 300 g/L or less, it is possible to obtain the effect of the invention.

In addition, in the present embodiment, even in a case where the concentration of the aggregating agent in the reaction solution is high, performing maintenance of the ink jet head makes it possible to eliminate ejection failures of the nozzle surface due to the reaction solution, thus the concentration of the aggregating agent in the reaction solution may be 0.03 mol/kg or more in 1 kg of the reaction solution. In addition, the concentration may be 0.1 mol/kg or more and 1.5 mol/kg or less, and may be 0.2 mol/kg or more and 0.9 mol/kg or less in 1 kg of the reaction solution. In addition, the content of the aggregating agent may be, for example, 0.1% by mass or more and 25% by mass or less with respect to the total mass of the reaction solution, may be 0.2% by mass or more and 20% by mass or less, or may be 0.3% by mass or more and 10% by mass or less.

Here, it is possible to confirm that the aggregating agent reacts with the resin which is included in the ink composition depending on, for example, whether or not the resin is aggregated in a "resin aggregability test". The "resin aggregability test" is, for example, performed by mixing and stirring while dropwise adding an aggregating agent solution adjusted to a predetermined concentration to a resin solution which includes a predetermined concentration of resin and confirming visually whether or not a precipitate is generated in the mixture.

1.2.2. Water

The reaction solution used in the present embodiment is preferably water as the main solvent. This water is a component which is evaporated and scattered by drying after attaching the reaction solution to the recording medium. As the water, water from which ionic impurities are removed as much as possible such as pure water or ultrapure water such as ion exchanged water, ultrafiltered water, reverse osmosis water, or distilled water is preferable. In addition, when water sterilized by ultraviolet irradiation or hydrogen peroxide addition or the like is used, it is possible to prevent the generation of mold and bacteria in a case where the reaction solution is stored for a long time, which is preferable. It is possible for the content of water which is included in the reaction solution to be set to, for example, 40% by mass or more with respect to the total mass of the reaction solution, preferably 49% by mass or more, more preferably 55% by mass or more and more preferably 65% by mass or more.

1.2.3. Organic Solvent

An organic solvent may be added to the reaction solution used in the present embodiment. It is possible to improve the wettability of the reaction solution with respect to the recording medium by adding an organic solvent. As the organic solvent, it is possible to use the same organic solvents as exemplified for the ink composition described below. The content of the organic solvent is not particularly limited; however, it is possible to set the content to, for example, 1% by mass or more and 40% by mass or less with respect to the total mass of the reaction solution.

Note that, the reaction solution includes a water-soluble organic solvent having a normal boiling point of 280° C. or less as an organic solvent and the content of the water-soluble organic solvent having a normal boiling point of more than 280° C. is preferably 3% by mass or less, more preferably 1% by mass or less, and even more preferably 0.5% by mass or less. In this case, since the drying property of the reaction solution is good, the drying in the maintenance step is performed quickly, and the stickiness of the recorded matter obtained in the recording step is reduced and the abrasion resistance is excellent. In addition, due to the drying property being good, the reaction solution tends to thicken easily in the nozzle of the ink jet head, and preliminary ejection is indispensable, thus the maintenance step in the present embodiment is effective.

As the water-soluble organic solvent having a normal boiling point of 280° C. or less, at least one type of water-soluble organic solvent of an alkanediol and an alkylene glycol monoether derivative is preferably used. In addition, the normal boiling point of the water-soluble organic solvent is preferably 250° C. or less, more preferably 230° C. or less, and even more preferably 210° C. or less. In addition, the content of the water-soluble organic solvent having a normal boiling point of 280° C. or less is more preferably 20% by mass or more, even more preferably 24% by mass or more, and still more preferably 40% by mass or more. Furthermore, the content of the water-soluble organic solvent having a normal boiling point of more than 280° C. is preferably 0.8% by mass or less, more preferably 0.5% by mass or less, and even more preferably 0.3% by mass or less.

1.2.4. Surfactant

A surfactant may be added to the reaction solution used in the present embodiment. Adding the surfactant makes it possible to lower the surface tension of the reaction solution, and to improve the wettability with the recording medium. Among the surfactants, for example, it is possible to preferably use an acetylene glycol-based surfactant, a silicon-based surfactant, and a fluorine-based surfactant. As specific examples of these surfactants, it is possible to use the same surfactants as those exemplified for the ink composition described below. The content of the surfactant is not particularly limited; however, it is possible to set the content to 0.1% by mass or more and 1.5% by mass or less with respect to the total mass of the reaction solution.

1.2.5. Other Components

A pH adjusting agent, an antiseptic/fungicide, a rust preventive agent, a chelating agent, and the like may be added to the reaction solution used in the present embodiment as necessary.

1.2.6. Physical Properties of Reaction Solution

In a case where the reaction solution used in the present embodiment is ejected by an ink jet recording head, the surface tension at 20° C. is preferably 20 mN/m or more and 40 mN/m or less, and more preferably 20 mN/m or more and mN/m or less. It is possible to measure the surface tension, for example, by confirming the surface tension when a platinum plate is wetted with ink in an environment of 20° C. using an automatic surface tensiometer CBVP-Z (trade name, manufactured by Kyowa Interface Science Co., Ltd.).

In addition, from the same viewpoint, the viscosity of the reaction solution used in the present embodiment at 20° C. is preferably 3 mPa·s or more and 10 mPa·s or less, and more preferably 3 mPa·s or more and 8 mPa·s or less. Here, it is possible to measure the viscosity in an environment of 20° C. using, for example, a viscoelasticity tester MCR-300 (trade name, manufactured by Pysica).

1.2.7. Method of Preparing Reaction Solution

It is possible to manufacture the reaction solution used in the present embodiment by dispersing and mixing each of the components described above by an appropriate method. After sufficiently stirring each of the components described above, filtration is performed in order to remove coarse particles and foreign materials which cause clogging to make it possible to obtain the desired reaction solution.

1.3. Maintenance Liquid

Next, description will be given of the maintenance liquid used in the method for maintaining an ink jet head according to the present embodiment. The maintenance liquid used in the present embodiment includes a water-soluble organic solvent having a boiling point of 280° C. or less and water. In the present embodiment, two examples of aspects of the maintenance liquid include a cleaning liquid used in a maintenance step of attaching a maintenance liquid to a nozzle surface of an ink jet head which ejects a reaction solution to clean the nozzle surface or a cap moisturizing liquid used in a maintenance step of covering and moisturizing a nozzle surface with a head moisturizing cap supplied with a maintenance liquid. Detailed description will be given below of the components included in the maintenance liquid and components which may be included in the maintenance liquid used in the present embodiment.

1.3.1. Water-Soluble Organic Solvent

The maintenance liquid used in the present embodiment includes a water-soluble organic solvent having a boiling point of 280° C. or less. Including a water-soluble organic solvent having a boiling point of 280° C. or less makes it possible to effectively remove the aggregating agent dried matter on the nozzle surface when cleaning the nozzle surface of the ink jet head which ejects the reaction solution. In addition, when the nozzle surface is covered with the head moisturizing cap supplied with the maintenance liquid, it is possible to suppress the reaction solution from drying in the nozzle and causing ejection failures. In this manner, due to the maintenance liquid used in the present embodiment including a water-soluble organic solvent having a boiling point of 280° C. or less, it is possible to eliminate ejection failures of the nozzle surface due to the reaction solution which includes the aggregating agent.

As the water-soluble organic solvent to be used in the maintenance liquid used in the present embodiment, it is preferable to use the same water-soluble organic solvent as included in the reaction solution described above and an ink described below. When the organic solvent included in the maintenance liquid and the organic solvent included in the reaction solution or ink are provided together, compatibility is enhanced and an excellent cleaning performance is obtained.

As the water-soluble organic solvent having a boiling point of 280° C. or less used in the present embodiment, alkanediol or alkylene glycol ether is preferable. It is possible for alkanediol and alkylene glycol ether to increase the moisturizing power of the maintenance liquid and to eliminate ejection failures of the nozzle surface due to the reaction solution. Furthermore, since it is possible to increase the antiseptic power of the maintenance liquid, it is possible to reduce the number of times of maintenance work such as cleaning in the cap device.

In addition, by using an alkanediol having a boiling point of 280° C. or less and an alkylene glycol ether having a boiling point of 280° C. or less, even if water included in the maintenance liquid in the cap device evaporates and the water-soluble organic solvent is concentrated, the moisture of the reaction solution or the ink composition attached in the vicinity of the ink jet head is hardly absorbed. Due to this, it is possible to prevent an increase in the viscosity of the reaction solution and the ink composition in the vicinity of the ink jet head, and to improve the ejection stability of the ink jet head.

Furthermore, since the maintenance liquid which contains the water-soluble organic solvent described above has lower surface tension than the maintenance liquid formed of water only, the wettability to the tube for supplying the maintenance liquid to the cap device is increased. Due to this, it is possible to improve the supply performance of the maintenance liquid.

In the present embodiment, the water-soluble organic solvent is preferably an alkanediol having 4 or more carbon atoms or an alkylene glycol ether. Since the alkanediol or alkylene glycol ether having 4 or more carbon atoms not only has a high moisturizing effect but also has a high ability to remove the solidified aggregating agent, it is possible to further eliminate ejection failures of the nozzle surface due to the reaction solution. The number of carbon atoms of the alkanediol or alkylene glycol ether is more preferably 5 or more, and even more preferably 6 or more. In addition, the number of carbon atoms of the alkanediol or alkylene glycol ether is preferably 15 or less, more preferably 12 or less, and even more preferably 10 or less.

In addition, in the present embodiment, as the water-soluble organic solvent, the normal boiling point is preferably 180° C. or more and 280° C. or less, more preferably 190° C. or more and 250° C. or less, and more preferably 200° C. or more and 230° C. or less. In a case where the normal boiling point is 180° C. or more and 280° C. or less, since the water-soluble organic solvent not only has a high moisturizing effect but also has a high ability to remove the solidified aggregating agent, it is possible to further eliminate ejection failures of the nozzle surface due to the reaction solution.

Examples of the alkanediols used in the present embodiment include 1,2-propanediol (propylene glycol, boiling point: 188° C.), 1,2-pentanediol (boiling point: 206° C.), 1,2-hexanediol (boiling point 223° C.), 1,3-hexanediol (boiling point: 223° C.), 1,3-butanediol (boiling point: 208° C.), 1,6-hexanediol (boiling point: 250° C.), 2,2-dimethylpropane-1,3-diol (neopentyl glycol) (boiling point: 210° C.), and the like. These compounds may be used singly or in a mixture of two or more types.

As the alkylene glycol ether used in the present embodiment, examples of alkylene glycol monoethers include ethylene glycol monomethyl ether, ethylene glycol monoethyl ether, ethylene glycol monoisopropyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, pentaethylene glycol monomethyl ether, pentaethylene glycol monoethyl ether, pentaethylene glycol monobutyl ether, propylene glycol monomethyl ether, propylene glycol monoethyl ether, dipropylene glycol monomethyl ether, dipropylene glycol monoethyl ether and the like. These compounds may be used singly or in a mixture of two or more types.

As the alkylene glycol ether used in the present embodiment, examples of alkylene glycol diethers include ethylene glycol dimethyl ether, ethylene glycol diethyl ether, ethylene glycol dibutyl ether, diethylene glycol dimethyl ether, diethylene glycol diethyl ether, diethylene glycol methyl ethyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and the like. The alkylene glycol diethers may be used singly or in a mixture of two or more types.

Note that, the alkylene glycol ether used in the present embodiment is preferably an alkylene glycol monoether, and examples thereof include ethylene glycol monomethyl ether (boiling point: 125° C.), diethylene glycol monomethyl ether (boiling point: 193° C.), ethylene glycol monobutyl ether (boiling point: 171° C.), diethylene glycol monobutyl ether (boiling point: 230° C.), propylene glycol monomethyl ether (boiling point: 121° C.), triethylene glycol monobutyl ether (boiling point: 272° C.), and the like.

The content of the water-soluble organic solvent with respect to the total mass of the maintenance liquid is preferably 3% by mass or more and 49% by mass or less, more preferably 4% by mass or more and 40% by mass or less, and particularly preferably 5% by mass or more and 30% by mass or less. The content of the water-soluble organic solvent being 3% by mass or more and 49% by mass or less makes it possible to eliminate ejection failures of the nozzle surface due to the reaction solution.

Note that, in the present embodiment, it is preferable that the maintenance liquid not include a water-soluble organic solvent having a boiling point exceeding 280° C. An organic solvent having a boiling point exceeding 280° C. absorbs moisture of the ink composition described below and may thicken the ink composition in the vicinity of the ink jet head. Due to this, the ejection stability of the ink jet head may be decreased.

Examples of an organic solvent having a boiling point exceeding 280° C. include glycerin. When a cap including a maintenance liquid to which a highly hygroscopic high boiling point organic solvent such as glycerin is added is left for a long time, moisture evaporates from the maintenance liquid in the cap, whereby the glycerin in the cap is concentrated. When such concentrated glycerin is present in the cap, moisture is absorbed from the ink composition attached to the head and the cap, which causes clogging of the head and malfunctions of the cap device. In addition, since glycerin is poor in antiseptic properties and allows mold and bacteria to easily propagate, glycerin is preferably not included in the maintenance liquid.

Accordingly, the content of the water-soluble organic solvent having a normal boiling point of more than 280° C. is preferably 3% by mass or less, more preferably 1% by mass or less, even more preferably 0.5% by mass or less, particularly preferably 0.1% by mass or less, and more particularly preferably 0.05% by mass or less.

1.3.2. Water

The maintenance liquid used in the present embodiment contains water. Water is the main component for exerting the moisturizing power of the maintenance liquid. The content of water with respect to the total mass of the maintenance liquid is preferably 50% by mass or more, more preferably 60% by mass or more, and even more preferably 70% by mass or more.

1.3.3. Other Components

A surfactant, a pH adjusting agent, an antiseptic/fungicide, a rust preventive agent, a coloring agent, a chelating agent, and the like may be added to the maintenance liquid used in the present embodiment as necessary. Adding the surfactant makes it possible to lower the surface tension of the maintenance liquid, and to improve the ability to remove the aggregating agent. Examples of surfactants include an acetylene glycol-based surfactant, a silicon-based surfactant, and a fluorine-based surfactant. In addition, controlling the pH by adding a pH adjusting agent makes it possible to prevent corrosion and the like of members forming the cap device. In this case, for example, it is possible to set the pH within a range from 5.0 to 9.0 by adding a pH adjusting agent. Examples of pH adjusting agents include alcohol amines such as triisopropanolamine, triethanolamine, triisopropanolamine, and the like.

As described above, the maintenance liquid includes a water-soluble organic solvent having a boiling point of 280° C. or less and water; however, if the liquid is the reaction solution described above and includes the water-soluble organic solvent having a boiling point of 280° C. or less and water, the liquid as may be used as the maintenance liquid. In this case, for example, a water-soluble organic solvent having a boiling point of 280° C. or less may be included in the reaction solution described above, and the components other than the portion including the water-soluble organic solvent having a boiling point of 280° C. or less, for example, water, may be reduced. In this case, making the reaction solution and the maintenance liquid similar in composition makes it possible to omit the labor for the preparation thereof. In addition, it is also possible to make the reaction solution and the maintenance liquid in common. In this case, it is preferable for the compositions of the reaction solution and the maintenance liquid to be close to each other in terms of good compatibility and an excellent cleaning recoverability.

1.3.4. Physical Properties of Maintenance Liquid

The viscosity of the maintenance liquid used in the present embodiment is not particularly limited as long as it is possible to eliminate ejection failures of the nozzle surface due to the reaction solution. For example, in a case where the maintenance liquid used in the present embodiment is ejected by an ink jet type recording head, it is preferable that the viscosity at 20° C. be 2 mPa·s or more and 15 mPa·s or less such that it is possible to easily eject the maintenance liquid from the nozzle opening portion, and more preferably 2 mPa·s or more and 10 mPa·s or less.

Note that, measurement of the viscosity is carried out by increasing the shear rate to 10 to 1000 under an environment of 20° C. using a viscoelasticity tester MCR-300 (manufactured by Pysica) and reading the viscosity at a shear rate of 200.

1.3.5. Method for Preparing Maintenance Liquid

It is possible to manufacture the maintenance liquid used in the present embodiment by dispersing and mixing each of the components described above by an appropriate method. After sufficiently stirring each of the components described above, filtration is performed in order to remove coarse particles and foreign material which cause clogging to make it possible to obtain the desired maintenance liquid.

1.4. Ink Composition

Next, description will be given of an ink composition used in a recording step to be described below. The ink composition used in the present embodiment contains, for example, a resin component, a water-soluble organic solvent having a boiling point of 280° C. or less, a surfactant, and water. Since such an ink composition has an extremely excellent ink drying property, it is possible to preferably use the ink composition for printing on a non-ink absorbing or low-ink absorbing recording medium. Description will be given below of the components included in the ink composition in the present embodiment.

1.4.1. Coloring Agent

The ink composition used in the present embodiment may contain a coloring agent. Examples of coloring agents include dyes, pigments, and the like, and pigments are preferably used since pigments have a property of being resistant to discoloration against light, gas and the like. Therefore, an image formed on a recording medium such as plastics using a pigment is excellent in water resistance, gas resistance, light resistance and the like, and the preservability is favorable.

The pigment usable in the present embodiment is not particularly limited, but examples thereof include inorganic pigments and organic pigments. As the inorganic pigment, in addition to titanium oxide and iron oxide, it is possible to use carbon black manufactured by a known method such as a contact method, a furnace method, a thermal method, or the like. On the other hand, as the organic pigments, it is possible to use azo pigments (including azo lakes, insoluble azo pigments, condensed azo pigments, chelate azo pigments, and the like), polycyclic pigments (for example, phthalocyanine pigments, perylene pigments, perinone pigments, anthraquinone pigments, quinophthalone pigment, and the like), nitro pigments, nitroso pigments, aniline black, and the like.

Among specific examples of pigments usable in the present embodiment, carbon blacks includes furnace black, lamp black, acetylene black, channel black or the like (C.I. Pigment Black 7), and commercially available products such as No. 2300, 900, MCF 88, No. 20B, No. 33, No. 40, No. 45, No. 52, MA7, MA8, MA77, MA100, No. 2200B, and the like (the above are all trade names, manufactured by Mitsubishi Chemical Corporation), Color Black FW 1, FW 2, FW 2V, FW 18, FW 200, S 150, S 160, S 170, PRETEX 35, U, V, 140U, Special Black 6, 5, 4A, 4, 250, and the like (the above are all trade names, manufactured by Degussa), Conductex SC, Raven 1255, 5750, 5250, 5000, 3500, 1255, 700, and the like (the above are all trade names, manufactured by Columbia Carbon Co., Ltd.), Rigall 400R, 330R, 660R, Mogul L, Monarch 700, 800, 880, 900, 1000, 1100, 1300, 1400, Elf Tech 12, and the like (the above are all trade names, manufactured by Cabot Corporation).

Examples of pigments used in the yellow ink include C.I. Pigment Yellow 1, 2, 3, 12, 13, 14, 16, 17, 73, 74, 75, 83, 93, 95, 97, 98, 109, 110, 114, 120, 128, 129, 138, 150, 151, 154, 155, 180, 185, 213, and the like.

Examples of pigments used for magenta ink include C.I. Pigment Red 5, 7, 12, 48 (Ca), 48 (Mn), 57 (Ca), 57:1, 112, 122, 123, 168, 184, 202, and 209, C.I. Pigment Violet 19, and the like.

Examples of pigments used in the cyan ink include C.I. Pigment Blue 1, 2, 3, 15:3, 15:4, 16, 22, 60, and the like.

Examples of pigments used for the green ink include C.I. Pigment Green 7, 8, 36, and the like.

Examples of pigments used for orange ink include C.I. Pigment Orange 43, 51, 66, and the like.

The content of the coloring agent contained in the ink composition is preferably 1.5% by mass or more and 10% by mass or less with respect to the total mass of the ink composition, and more preferably 2% by mass or more and 7% by mass or less.

In order to apply the pigment described above to the ink composition, it is necessary to be able to stably disperse and retain the pigment in water. Methods thereof include a method of dispersing with a resin dispersant such as a water-soluble resin and/or a water-dispersible resin (below, the pigment dispersed by this method is referred to as a "resin-dispersed pigment"), a method of dispersing with a surfactant of a water-soluble surfactant and/or a water-dispersible surfactant (below, the pigment dispersed by this method is referred to as a "surfactant-dispersed pigment"), a method in which a hydrophilic functional group is chemically and physically introduced to the surface of the pigment particle so as to be dispersed and/or dissolvable in water without the above-described resin or a dispersant such as a surfactant (below the pigment dispersed by this method is referred to as a "surface-treated pigment"), and the like. In the present embodiment, it is possible to use any of the resin-dispersed pigment, the surfactant-dispersed pigment, and the surface-treated pigment described above as the ink composition, and it is also possible to use a mixture of a plurality of types as necessary.

Examples of resin dispersants used in the resin-dispersed pigment include polyvinyl alcohols, polyvinyl pyrrolidones, polyacrylic acid, acrylic acid-acrylonitrile copolymers, vinyl acetate-acrylic acid ester copolymers, acrylic acid-acrylic acid ester copolymers, styrene-acrylic acid copolymers, styrene-methacrylic acid copolymers, styrene-methacrylic acid-acrylic acid ester copolymers, a styrene-α-methylstyrene-acrylic acid copolymers, a styrene-α-methylstyrene-acrylic acid-acrylic acid ester copolymers, styrene-maleic acid copolymers, styrene-maleic anhydride copolymers, vinylnaphthalene-acrylic acid copolymers, vinylnaphthalene-maleic acid copolymers, vinyl acetate-maleic acid ester copolymers, vinyl acetate-crotonic acid copolymers, vinyl acetate-acrylic acid copolymers, and the like and salts thereof. Among these, in particular, a copolymer of a monomer having a hydrophobic functional group and a monomer having a hydrophilic functional group, and a polymer formed of a monomer having both a hydrophobic functional group and a hydrophilic functional group are preferable. As the form of the copolymer, it is possible to use any of a random copolymer, a block copolymer, an alternating copolymer, and a graft copolymer.

Examples of the salts described above include salts with a basic compound such as ammonia, ethylamine, diethylamine, triethylamine, propylamine, isopropylamine, dipropylamine, butylamine, isobutylamine, diethanolamine, triethanolamine, tri-iso-propanolamine, aminomethylpropanol, and morpholine. The addition amount of these basic compounds is not particularly limited as long as the amount is the neutralization equivalent or more of the resin dispersant described above.

The molecular weight of the resin dispersant described above is preferably in the range of 1,000 to 100,000, and more preferably in the range of 3,000 to 10,000 as the weight average molecular weight. By the molecular weight being within the range described above, a stable dispersion of the coloring agent in water is obtained, and viscosity control and the like are easily carried out when application is made to an ink composition.

It is also possible to use commercially available products as the resin dispersant described above. Specifically, examples thereof include Joncryl 67 (weight average molecular weight: 12,500, acid value: 213), Joncryl 678 (weight average molecular weight: 8,500, acid value: 215), Joncryl 586 (weight average molecular weight: 4,600, acid value: 108), Joncryl 611 (weight average molecular weight: 8,100, acid value: 53), Joncryl 680 (weight average molecular weight: 4,900, acid value: 215), Joncryl 682 (weight average molecular weight 1,700, acid value: 238), Joncryl 683 (weight average molecular weight: 8,000, acid value: 160), Joncryl 690 (weight average molecular weight: 16,500, acid value: 240), (the above are trade names, manufactured by BASF Japan Ltd.), and the like.

In addition, examples of surfactants used in the surfactant-dispersed pigment include anionic surfactants such as alkane sulfonate, α-olefin sulfonate, alkylbenzene sulfonate, alkyl naphthalene sulfonate, acyl methyl taurate, dialkyl sulfosuccinate, alkylsulfuric acid ester salts, sulfated olefins, polyoxyethylene alkyl ether sulfuric acid ester salts, alkylphosphoric acid ester salts, polyoxyethylene alkyl ether phosphoric acid ester salts, and monoglyceride phosphoric acid ester salts, amphoteric surfactants such as alkylpyridium salts, alkylamino acid salts, and alkyldimethylbetaine, and nonionic surfactants such as polyoxyethylene alkyl ethers, polyoxyethylene alkyl phenyl ethers, polyoxyethylene alkyl esters, polyoxyethylene alkyl amides, glycerin alkyl esters, and sorbitan alkyl esters.

The addition amount of the resin dispersant or the surfactant with respect to the pigment is preferably 1 part by mass to 100 parts by mass, and more preferably 5 parts by mass to 50 parts by mass with respect to 100 parts by mass of the pigment. Within this range, it is possible to secure the dispersion stability of the pigment in water.

In addition, examples of surface-treated pigments include, as a hydrophilic functional group, —OM, —COOM, —CO—, —$SO_3M$, —$SO_2NH_3$, —$RSO_3M$, —$PO_3HM$, —$PO_3M_3$, —$SO_3NHCOR$, —$NH_3$, —$NR_3$ (here, M in the formula represents a hydrogen atom, an alkali metal, ammonium or organic ammonium, R represents an alkyl group having 1 to 12 carbon atoms, a phenyl group which may have a substituent, or a naphthyl group which may have a substituent) and the like. These functional groups are introduced physically and/or chemically by grafting directly to the pigment particle surface and/or via other groups. Examples of polyvalent groups include an alkylene group having 1 to 12 carbon atoms, a phenylene group which may have a substituent, a naphthylene group which may have a substituent, and the like.

In addition, as the surface-treated pigment, a pigment which is surface-treated using a sulfur-containing treatment agent such that —$SO_3M$ and/or —$RSO_3M$ (M is a counter ion and indicates a hydrogen ion, an alkali metal ion, an ammonium ion, or an organic ammonium ion) are chemically bonded to each other on the surface of the pigment particle is preferable. That is, it is preferable that the pigment have no active protons and have no reactivity with sulfonic acid, that the pigment be dispersed in a solvent in which the pigment is insoluble or hardly soluble and then surface treated using amidosulfuric acid or a complex of sulfur trioxide and a tertiary amine such that —$SO_3M$ and/or —$RSO_3M$ chemically bond with each other on the particle surface thereof, and that the pigment be able to be dispersed and/or dissolved in water.

As surface treatment means for grafting the functional group or a salt thereof on the surface of the pigment particle directly or via a polyvalent group, it is possible to apply various known surface treatment means. Examples of such means include means for applying ozone or a sodium hypochlorite solution to commercially available oxidized carbon black and subjecting the carbon black to further oxidation treatment to make the surface more hydrophilic (for example, JP-A-7-258578, JP-A-8-3498, JP-A-10-120958, JP-A-10-195331, and JP-A-10-237349), means for treating carbon black with 3-amino-N-alkyl substituted pyridium bromide (for example, JP-A-10-195360 and JP-A-10-330665), means in which an organic pigment is dispersed in a solvent in which the organic pigment is insoluble or hardly soluble, and a sulfone group is introduced onto the surface of the pigment particle with a sulfonating agent (for example, JP-A-8-283596, JP-A-10-110110, and JP-A-10-110111), means in which an organic pigment is dispersed in a basic solvent which forms a complex with sulfur trioxide, the surface of the organic pigment is treated by adding sulfur trioxide, and a sulfone group or a sulfone amine group is introduced (for example, JP-A-10-110114), and the like; however, the means for manufacturing the surface-treated pigment used in the invention is not limited to these means.

The number of functional groups grafted to one pigment particle may be single or plural. The type and degree of the grafted functional group may be appropriately determined in consideration of the dispersion stability in the ink, the color concentration, the drying property on the front face of the ink jet head, and the like.

As a method of dispersing the resin-dispersed pigment, the surfactant-dispersed pigment, and the surface-treated pigment described above in water, the method is performed with a pigment, water, and a resin dispersant for the resin-dispersed pigment, a pigment, water, and a surfactant for the surfactant-dispersed pigment, a surface-treated pigment and water for the surface-treated pigment, or by adding each of a water-soluble organic solvent/neutralizer and the like as necessary, in a dispersion device used in the related art such as a ball mill, a sand mill, an attritor, a roll mill, an agitator mill, a Henschel mixer, a colloid mill, an ultrasonic homogenizer, a jet mill, or an angmill. In this case, dispersing until the pigment particle diameter is in a range of 20 nm to 500 nm as the average particle diameter, more preferably in a range of 50 nm to 200 nm, is preferable in terms of ensuring the dispersion stability of the pigment in water.

1.4.2. Resin Component

In the present embodiment, the ink composition contains a water-soluble and/or water-insoluble resin component. The resin component has the function of solidifying the ink and firmly fixing the ink solidified substance on the recording medium. The resin component may be in a state of being dissolved in the ink composition or in a state of being dispersed in the ink composition. As the resin component in the dissolved state, it is possible to use the resin dispersant described above used in a case of dispersing a pigment as a coloring agent of the ink composition used in the present embodiment. In addition, as a resin in a dispersed state, it is possible to include a resin component which is hardly soluble or insoluble in the liquid medium of the ink composition used in the present embodiment dispersed in a fine particle form (that is, in an emulsion state or a suspension state).

Examples of resin components include polyacrylic acid esters or copolymers thereof, polymethacrylic acid esters or copolymers thereof, polyacrylonitrile or copolymers thereof, polycyanoacrylate, polyacrylamide, polyacrylic acid, polymethacrylic acid, polyethylene, polypropylene, polybutene, polyisobutylene, polystyrene or copolymers thereof, petroleum resin, chromane indene resin, terpene resin, polyvinyl acetate or copolymers thereof, polyvinyl alcohol, polyvinyl acetal, polyvinyl ether, polyvinyl chloride or copolymers thereof, polyvinylidene chloride, fluororesin, fluororubber, polyvinylcarbazole, polyvinylpyrrolidone or copolymers thereof, polyvinylpyridine, polyvinylimidazole, polybutadiene or copolymers thereof, polychloroprene, polyisoprene, natural resins, and the like. Among these, those having both a hydrophobic portion and a hydrophilic portion in the molecular structure are particularly preferable.

It is possible to obtain the resin component in a fine particle state described above by the following methods, any of which may be used, or any combination of a plurality of which may be used as necessary. Examples of methods include a method in which a polymerization catalyst (polymerization initiator) and a dispersant are mixed in a monomer forming a desired resin component and polymerized (that is, emulsion polymerization), a method of obtaining the resin component by dissolving a resin component having a hydrophilic portion in a water-soluble organic solvent, mixing the solution in water, and then removing the water-soluble organic solvent by distillation or the like, a method of obtaining the resin component by dissolving the resin component in a water-insoluble organic solvent, and mixing the solution in an aqueous solution with the dispersant, and the like. It is possible to appropriately select the method described above according to the type and characteristics of the resin component used. The dispersant which is able to be used when dispersing the resin component is not particularly limited; however, examples thereof include anionic surfactants (for example, sodium dodecylbenzenesulfonate, sodium lauryl phosphate, polyoxyethylene alkyl ether sulfate ammonium salts, and the like), non-ionic surfactants (for example, polyoxyethylene alkyl ethers, polyoxyethylene alkyl esters, polyoxyethylene sorbitan fatty acid esters, polyoxyethylene alkylphenyl ethers, and the like), and it is possible to use these singly or in a combination of two types or more.

In a case where the resin component described above is used in the form of fine particles (emulsion form or suspension form), it is also possible to use resin components obtained by known materials and methods. For example, those resin components described in JP-B-62-1426, JP-A-3-56573, JP-A-3-79678, JP-A-3-160068, and JP-A-4-18462 may be used. In addition, it is also possible to use commercially available products, and examples thereof include Microgel E-1002, Microgel E-5002 (the above are all trade names, manufactured by Nippon Paint Co., Ltd.), Boncoat 4001, Boncoat 5454 (the above are all trade names, manufactured by DIC Corporation), SAE 1014 (trade name, manufactured by Zeon Corporation), Cybinol SK-200 (trade name, manufactured by Saiden Chemical Industry Co., Ltd.), Joncryl 7100, Joncryl 390, Joncryl 711, Joncryl 511, Joncryl 7001, Joncryl 632, Joncryl 741, Joncryl 450, Joncryl 840, Joncryl 74J, Joncryl HRC-1645J, Joncryl 734, Joncryl 852, Joncryl 7600, Joncryl 775, Joncryl 537J, Joncryl 1535, Joncryl PDX-7630A, Joncryl 352J, Joncryl 352D, Joncryl PDX-7145, Joncryl 538J, Joncryl 7640, Joncryl 7641, Joncryl 631, Joncryl 790, Joncryl 780, Joncryl 7610 (the above are all trade names, manufactured by BASF Japan Ltd.), and the like.

In a case where the resin component is used in a fine particle state, from the viewpoint of ensuring the storage stability and ejection stability of the ink composition, the average particle diameter thereof is preferably in the range of 5 nm to 400 nm, and more preferably in the range of 50 nm to 200 nm.

The content of the resin component is preferably 0.1% by mass or more and 15% by mass or less with respect to the total amount of the ink composition, and more preferably 0.5% by mass or more and 10% by mass or less in terms of solid content. Within this range, even on a plastic medium, it is possible to solidify and fix the ink composition used in the ink jet recording method according to the present embodiment.

1.4.3. Water-Soluble Organic Solvent

In the present embodiment, the ink composition contains a water-soluble organic solvent having a boiling point of 280° C. or less. When the boiling point of the water-soluble organic solvent is 280° C. or less, the drying properties of the ink composition ejected on the recording medium are favorable and it is possible to obtain an image excellent in abrasion resistance.

Examples of water-soluble organic solvents having a boiling point of 280° C. or less used in the ink composition include 1,2-alkanediols, polyhydric alcohols, pyrrolidone derivatives, and the like.

There are no particular restrictions on the 1,2-alkanediols as long as the boiling point is 280° C. or less; however, examples thereof include 1,2-butanediol (boiling point: 194° C.), 1,2-pentanediol (boiling point: 206° C.), 1,2-hexanediol (boiling point: 223° C.), and the like. Since 1,2-alkanediols enhance the wettability of the ink composition with respect to the recording medium and have an excellent uniform wetting action, it is possible to form an excellent image on the recording medium. The content of the 1,2-alkanediols is preferably 1% by mass or more and 8% by mass or less with respect to the total mass of the ink composition.

There are no particular restrictions on the polyhydric alcohols as long as the boiling point is 280° C. or less; however, examples of polyhydric alcohols include ethylene glycol (boiling point: 197° C.), diethylene glycol (boiling point: 244° C.), propylene glycol (boiling point: 188° C.), dipropylene glycol (boiling point: 232° C.), 1,3-propanediol (boiling point: 210° C.), 1,4-butanediol (boiling point: 230° C.), 1,6-hexanediol (boiling point: 208° C.), and the like. Among the above, from the viewpoint of high vapor pressure and not inhibiting drying of the image, ethylene glycol, diethylene glycol, propylene glycol, dipropylene glycol, and 1,6-hexanediol are preferable. Polyhydric alcohols have an action of preventing clogging and ejection failures and the like by suppressing drying and solidification of ink on the nozzle surface of the ink jet head and a polyhydric alcohol with high vapor pressure is preferable since evaporation and scattering with the moisture are desirable. The content of the polyhydric alcohols is preferably 2% by mass or more and 20% by mass or less with respect to the total mass of the ink composition.

There are no particular restrictions on the pyrrolidone derivative as long as the pyrrolidone derivative has a boiling point of 280° C. or less and examples thereof include N-methyl-2-pyrrolidone, N-ethyl-2-pyrrolidone, N-vinyl-2-pyrrolidone, 2-pyrrolidone, N-butyl-2-pyrrolidone, 5-methyl-2-pyrrolidone, and the like. The pyrrolidone derivative acts as a favorable dissolving agent for the thermoplastic resin. The content of the pyrrolidone derivative is preferably 3% by mass or more and 25% by mass or less with respect to the total mass of the ink composition.

In the present embodiment, in the same manner as the maintenance liquid, it is preferable that the ink composition not include a water-soluble organic solvent having a boiling point exceeding 280° C. An organic solvent having a boiling point exceeding 280° C. absorbs the moisture of the ink composition and may thicken the ink composition in the vicinity of the ink jet head. Due to this, the ejection stability of the ink jet head may be lowered.

Examples of an organic solvent having a boiling point exceeding 280° C. include glycerin. Similarly to the maintenance liquid, in a case where high boiling point organic solvent having high hygroscopicity such as glycerin is added, clogging of the head and malfunctions of the cap device are caused. In addition, since glycerin is poor in antiseptic properties and easily allows mold and bacteria to propagate, it is preferably not included in the ink composition.

Accordingly, in the ink composition, the content of the water-soluble organic solvent having a normal boiling point exceeding 280° C. is preferably 3% by mass or less, more preferably 1% by mass or less, even more preferably 0.5% by mass or less, particularly preferably 0.1% by mass or less, and more particularly preferably 0.05% by mass or less.

1.4.4. Surfactant

In the present embodiment, it is preferable that the ink composition contain a surfactant. Examples of surfactants include a silicon-based surfactant, an acetylene glycol-based surfactant, and the like.

As the silicon-based surfactant, a polysiloxane compound or the like is preferably used, and examples thereof include a polyether modified organosiloxane and the like. More specifically, examples thereof include BYK-306, BYK-307, BYK-333, BYK-341, BYK-345, BYK-346, BYK-348, (the above are trade names, manufactured by BYK Additives & Instruments), KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (the above are trade names, manufactured by Shin-Etsu Chemical Co., Ltd.), and the like. The silicon-based surfactant is preferable in terms of having a function of uniformly spreading so as to not cause uneven density or bleeding of the ink on the plastic medium. The content of the silicon-based surfactant is preferably 0.1% by mass or more and 1.5% by mass or less with respect to the total mass of the ink composition.

Examples of acetylene glycol-based surfactants include Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, and GA (the above are all trade names, manufactured by Air Products and Chemicals. Inc.), Olfine B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (the above are all trade names, manufactured by Nissin Chemical Industry Co., Ltd.), Acetylenol E00, E00P, E40, and E100 (the above are all trade names, manufactured by Kawaken Fine Chemicals Co., Ltd.), and the like. Compared to other surfactants, the acetylene glycol-based surfactant is excellent in the ability to properly maintain the surface tension and the interfacial tension, and has a feature that there is almost no foaming property. Due to this, since it is possible for the ink composition containing the acetylene glycol-based surfactant to properly maintain the surface tension and the interfacial tension with the member of the head nozzle surface or the like in contact with the ink, it is possible to increase the ejection stability in a case where the above is applied to an ink jet recording method. In addition, since the ink composition containing the acetylene glycol-based surfactant exhibits favorable wettability and permeability to the recording medium, it is possible to obtain a high-definition image with little density unevenness and bleeding of the ink. The content of the acetylene-based surfactant is preferably 0.1% by mass or more and 1.0% by mass or less with respect to the total mass of the ink composition.

1.4.5. Water

In the present embodiment, the ink composition contains water. Water is the main medium of the ink composition and is a component which is evaporated and scattered by drying. Water from which ionic impurities are removed as much as possible such as pure water or ultrapure water such as ion exchanged water, ultrafiltered water, reverse osmosis water, or distilled water is preferable. In addition, when water sterilized by ultraviolet irradiation or hydrogen peroxide addition or the like is used, it is possible to suppress the generation of mold and bacteria in a case where the pigment dispersion and the ink composition using the same is stored for a long time, which is preferable.

1.4.6. Other Components

In the present embodiment, the ink composition may further contain a pH adjusting agent, a polyolefin wax, an antiseptic/fungicide, a rust preventive agent, a chelating agent, and the like. When these materials are added, it is possible to further improve the properties of the ink composition.

Examples of pH adjusting agents include potassium dihydrogen phosphate, disodium hydrogen phosphate, sodium hydroxide, lithium hydroxide, potassium hydroxide, ammonia, diethanolamine, triethanolamine, triisopropanolamine, potassium carbonate, sodium carbonate, sodium bicarbonate, and the like.

Examples of polyolefin waxes include waxes and copolymers thereof manufactured from olefins or derivatives thereof such as ethylene, propylene, butylene and the like, and specific examples include polyethylene wax, polypropylene wax, polybutylene wax, and the like. It is possible to use commercially available polyolefin waxes and it is possible to specifically use Nopcoat PEM 17 (trade name, manufactured by San Nopco Limited), Chemipearl W4005 (trade name, manufactured by Mitsui Chemicals, Inc.), AQUACER 515, AQUACER 593 (the above are trade names, manufactured by BYK Additives & Instruments) or the like.

When polyolefin wax is added, it is possible to improve the slipping property with respect to physical contact of the image formed on the ink non-absorbing or low absorbing recording medium and to improve the abrasion resistance of the image, which is preferable. The content of the polyolefin wax is preferably 0.01% by mass or more to 10% by mass or less with respect to the total mass of the ink composition, and more preferably 0.05% by mass or more to 1% by mass or less. When the content of the polyolefin wax is within the range described above, the effects described above are sufficiently exhibited.

Examples of antiseptic/fungicide agents include sodium benzoate, sodium pentachlorophenol, sodium 2-pyridinethiol-1-oxide, sodium sorbate, sodium dehydroacetate, 1,2-dibenzisothiazolin-3-one, and the like. Examples of commercially available products include Proxel XL 2, Proxel GXL (the above are trade names, manufactured by Avecia Ltd.), Denicide CSA, and NS-500 W (the above are trade names, manufactured by Nagase ChemteX Corporation), and the like.

Examples of rust preventive agents include benzotriazole and the like.

Examples of chelating agents include ethylenediaminetetraacetic acid, salts thereof (disodium dihydrogen ethylenediamine tetraacetate salt, and the like) and the like.

1.4.7. Physical Properties of Ink Composition

From the viewpoint of the balance between image quality and reliability as ink for ink jet recording, the ink composition used in the present embodiment preferably has a surface tension of 20 mN/m or more and 40 mN/m or less at 20° C., and more preferably 20 mN/m or more and 35 mN/m or less. It is possible to measure the surface tension, for example, by confirming the surface tension when a platinum plate is wetted with ink in an environment of 20° C. using an automatic surface tensiometer CBVP-Z (trade name, manufactured by Kyowa Interface Science Co., Ltd.).

In addition, from the same viewpoint, the viscosity of the ink composition used in the present embodiment at 20° C. is preferably 3 mPa·s or more and 10 mPa·s or less, and more preferably 3 mPa·s or more and 8 mPa·s or less. Here, it is possible to measure the viscosity in an environment of 20°

C. using, for example, a viscoelasticity tester MCR-300 (trade name, manufactured by Pysica).

1.4.8. Usage

Since the ink composition used in the present embodiment has an extremely excellent ink drying property, it is possible to preferably use the ink composition for printing on an ink non-absorbing or low absorbing recording medium.

Examples of an ink non-absorbing recording medium include a plastic film, which is not surface treated for ink jet printing (that is, no ink absorbing layer is formed), a medium where plastic is coated on a substrate such as paper, a medium bonded with a plastic film, or the like. Here, examples of plastics include polyvinyl chloride, polyethylene terephthalate, polycarbonate, polystyrene, polyurethane, polyethylene, polypropylene, and the like. An example of a low ink absorbing recording medium is printing paper such as art paper, coated paper, and matte paper. Note that, in this specification, an ink non-absorbing or low absorbing recording medium is also referred to simply as a "plastic medium".

Here, the "ink non-absorbing or low absorbing recording medium" in the present specification means a "recording medium having a water absorption amount of 10 mL/$m^2$ or less from the start of contact to 30 $msec^{1/2}$ in the Bristow method". This Bristow method is the most widespread method for measuring amounts of liquid absorption in a short time and is also adopted by Japan Technical Association of the Pulp and Paper Industry (JAPAN TAPPI). The details of the test method are related in standard No. 51 "Paper and paperboard-Liquid absorbency test method-Bristow method" of "JAPAN TAPPI 2000 Paper Pulp Test method".

Examples of the ink non-absorbing recording medium include a plastic film not having an ink absorbing layer, a medium where plastic is coated on a substrate such as paper, a medium bonded with a plastic film, or the like. Here, examples of plastics include polyvinyl chloride, polyethylene terephthalate, polycarbonate, polystyrene, polyurethane, polyethylene, polypropylene, and the like.

An example of a recording medium with a low ink absorption property is a recording medium provided with a coating layer for receiving ink on the surface thereof and examples of a recording medium with paper as a substrate include printing paper such as art paper, coated paper, and mat paper, and examples of a recording medium in a case where the substrate is a plastic film include a medium in which a hydrophilic polymer is coated on a surface of polyvinyl chloride, polyethylene terephthalate, polycarbonate, polystyrene, polyurethane, polyethylene, polypropylene, or the like, and a medium in which particles such as silica and titanium are coated along with a binder. These recording media may be transparent recording media.

2. Method for Maintaining Ink Jet Head

Next, description will be given of an example of a method for maintaining an ink jet head according to the present embodiment.

2.1. Maintenance Step 2.1.1. Maintenance Step Using Moisturization

The maintenance step of the method for maintaining an ink jet head according to the present embodiment is at least one of a maintenance step of attaching a maintenance liquid to a nozzle surface of an ink jet head, which ejects a reaction solution including an aggregating agent for aggregating or thickening components of an ink composition, to clean the nozzle surface, and a maintenance step of covering and moisturizing the nozzle surface with a head moisturizing cap supplied with a maintenance liquid.

Here, in the case of using the ink jet recording apparatus 100 shown in FIGS. 1 to 5 described above to cover and moisturize the nozzle surface with the first cap device 40 supplied with the maintenance liquid, as described above, the cap portion 44 of the first cap device 40 comes into contact with the bottom surface S1 of the carriage 12 returned to the home position H1 and switched to the standby state after printing completion, and forms a substantially sealed space AR1 surrounded by the bottom surface S1, the cap portion 44, and the absorbent material 46. At this time, since the maintenance liquid is held on the absorbent material 46, the maintenance liquid is evaporated to humidify the space AR1.

At this time, it is preferable that the maintenance liquid be supplied such that the amount of the maintenance liquid supplied to the first cap device 40, that is, the amount of the maintenance liquid supplied to the substantially sealed space AR1 surrounded by the bottom surface S1 of the head 16, the cap portion 44, and the absorbent material 46, is 0.1 g/$cm^3$ or more. The supplied amount of the maintenance liquid is more preferably 0.2 g/$cm^3$ or more, even more preferably 0.5 g/$cm^3$ or more, and particularly preferably 1 g/$cm^3$ or more. Due to the supplied amount being 0.1 g/$cm^3$ or more, the moisture retention of the nozzle surface is sufficient, and it is possible to further eliminate ejection failures of the nozzle surface due to the reaction solution. The supply of the maintenance liquid may be an amount supplied before the head 16 is covered with the first cap device 40 and may be the total amount supplied while the head 16 is covered with the first cap device 40 and moisturized.

The moisturizing time for moisturizing the nozzle surface is preferably 30 minutes or more, more preferably 40 minutes or more, and even more preferably 50 minutes or more. Due to the moisturizing time being 30 minutes or more, it is possible to eliminate ejection failures of the nozzle surface due to the reaction solution.

After moisturizing the nozzle surface as described above, the second cap device 300 performs a suction recovery process for suctioning and removing the ink and the reaction solution in the head 16, and the ink and reaction solution discharged to the second cap device 300 may be removed.

In the method for maintaining an ink jet head according to the present embodiment, in the maintenance step described above, since the humidification of the head 16 is sufficient and drying of the nozzle surface is prevented due to the maintenance liquid including a water-soluble organic solvent having a boiling point of 280° C. or less and water, it is possible to eliminate ejection failures of the nozzle surface due to the reaction solution.

In the case where the head 16 is covered with the first cap device 40, a configuration may be adopted in which the nozzle surface is immersed in the maintenance liquid, in addition to moisturizing the nozzle surface in a non-contact manner. In this manner, in a case where the nozzle surface is in direct contact with the maintenance liquid, since the maintenance liquid dissolves or swells and removes the dried reaction solution solid matter attached to the nozzle surface, it is possible to eliminate the ejection failures of the nozzle surface due to the reaction solution. In addition, a configuration which does not use the absorbent material 46 may be adopted.

In addition, when ejecting ink or reaction solution from the ink jet head 16, it is possible to eliminate ejection failures on the nozzle surface due to the reaction solution even in a state where the recording medium is heated and the surface temperature of the recording medium is, for example, 45° C. or less; however, in order to further reduce the occurrence of ejection failures of the nozzle surface due to the reaction solution, the surface temperature of the recording medium is preferably 20° C. or more and 40° C. or less, and more preferably 33° C. or more and 38° C. or less.

2.1.2. Maintenance Step Using Cleaning

In a case where, in the maintenance step, cleaning the nozzle surface is performed by attaching the maintenance liquid to the nozzle surface of the ink jet head, for example, the nozzle surface of the head is wiped with an absorbent body impregnated with the maintenance liquid by pressing means or the like pressing a wiping member onto the nozzle surface of the ink jet head so as to apply a pressing load. Alternatively, the nozzle surface is cleaned by a method of spraying a maintenance liquid onto the nozzle surface by spraying means such as an ink jet recording type head and wiping the nozzle surface to which the maintenance liquid is attached using wiping means.

In these cases, due to the maintenance liquid including a water-soluble organic solvent having a boiling point of 280° C. or less and water, it is possible to eliminate the ejection failures of the nozzle surface due to the reaction solution since the nozzle surface comes into direct contact with the maintenance liquid and the maintenance liquid dissolves or swells and removes the dried reaction solution solid matter attached to the nozzle surface.

Here, even in maintenance using cleaning, as described above, the effect can be obtained even in a case where the recording is performed by heating and the reaction solution solidifies easily.

In addition, as a maintenance step, it is possible to obtain the effect of the invention as long as either of moisturizing and cleaning is provided; however, in order to obtain a greater effect, it is preferable to provide both of the moisturizing and cleaning steps described above.

2.2. Step Other than Maintenance Step (Recording Step)

The recording step is a step of recording on a recording medium by ejecting an ink composition, which include a coloring material, and a reaction solution, which includes an aggregating agent for aggregating or thickening the components of the ink composition, from an ink jet head, before or after the maintenance step described above. In the present embodiment, since the maintenance step described above is performed before or after the recording step, ejection failures of the nozzle surface due to the reaction solution are eliminated, ejection stability at the time of recording is obtained, and the image quality is improved.

Here, the recording step is for recording an image by ejecting each of liquid droplets of an ink composition from the nozzle of an ink jet head and liquid droplets of a reaction solution including an aggregating agent so as to be attached on the recording medium surface. Due to this, an image formed of the ink composition is formed on the surface of the recording medium.

In the invention, "image" refers to a recording pattern formed from a group of dots, including text printing and solid images. Note that, "solid image" means an image pattern for an image where dots are recorded in all the pixels which are the minimum recording unit area defined by the recording resolution and, usually, the recording area of the recording medium is covered with ink and the base of the recording medium is not visible.

Note that, after the recording step, a drying step of drying the ink composition attached to the recording medium may be provided. In such a case, it is preferable to carry out drying to the extent that stickiness is not felt when touching the ink composition attached to the recording medium surface. The drying step of the ink composition may be carried out by air drying, but drying by heating is preferable. In the method for maintaining an ink jet head according to the present embodiment, since the maintenance liquid has a high effect of dissolving or swelling and removing the dried reaction solution solid matter attached to the nozzle surface, ejection failures of the nozzle surface due to the reaction solution are eliminated even when there is a drying step and the environment is one in which the nozzles are easily clogged.

3. Examples

More specific description will be given of the embodiment of the invention using Examples; however, the present embodiment is not limited to these Examples.

3.1. Preparation of Reaction Solution, Maintenance Liquid, and Ink Composition

Preparation of Reaction Solution 1 to 5

After each component was mixed and stirred to be the blending ratios shown in Table 1, filtering was carried out through a 10 μm membrane filter to prepare each reaction solution. Note that, all the values in Table 1 indicate % by mass, and ion exchanged water was added such that the total mass of the reaction solution was 100% by mass.

Preparation of Maintenance Liquids 1 to 9

After each component was mixed and stirred to be the blending ratios shown in Table 1, filtering was carried out through a 10 μm membrane filter to prepare each maintenance liquid (also referred to below as "maintenance liquid"). Note that, all the values in Table 1 represent % by mass, and ion exchanged water was added such that the total mass of the maintenance liquid was 100% by mass.

Preparation of Ink Composition 1

An ink composition 1 (also referred to below as "ink 1") was obtained by mixing and stirring each component to be the blending ratios of Table 1. Note that, the values in Table 1 all indicate % by mass, and ion exchanged water was added such that the total mass of the ink composition 1 was 100% by mass.

The compositions of the reaction solution, the maintenance liquid, and the ink composition are shown in Table 1 below.

TABLE 1

| | Solubility of aggregating agent in water (g/L 20° C.) | Reaction solution 1 | Reaction solution 2 | Reaction solution 3 | Reaction solution 4 | Reaction solution 5 | Maintenance liquid 1 | Maintenance liquid 2 | Maintenance liquid 3 |
|---|---|---|---|---|---|---|---|---|---|
| 1,2-hexanediol (boiling point: 223° C.) | | 4 | 4 | 4 | 4 | 4 | 4 | 0 | 0 |

TABLE 1-continued

| | | | | | | | | | |
|---|---|---|---|---|---|---|---|---|---|
| Propylene glycol (boiling point: 189° C.) | | 20 | 20 | 45 | 20 | 0 | 25 | 0 | 0 |
| 1,3-butanediol (boiling point: 208° C.) | | 0 | 0 | 0 | 0 | 0 | 0 | 29 | 0 |
| Propylene glycol monomethyl ether (boiling point: 121° C.) | | 0 | 0 | 0 | 0 | 0 | 0 | 0 | 0 |
| Triethylene glycol monobutyl ether (boiling point: 272° C.) | | 0 | 0 | 0 | 0 | 0 | 0 | 0 | 0 |
| Glycerine (boiling point: 290° C.) | | 0 | 0 | 0 | 0 | 20 | 0 | 0 | 25 |
| Silicon-based surfactant BYK348 | | 1 | 1 | 1 | 1 | 1 | 1 | 1 | 1 |
| Polyvalent metal salt A: calcium acetate monohydrate (mol/kg) | 400 | 0.3 | 0 | 0.3 | 0 | 0.3 | 0 | 0 | 0 |
| Polyvalent metal salt B: magnesium sulfate heptahydrate (mol/kg) | 255 | — | 0.3 | 0 | 0 | 0 | 0 | 0 | 0 |
| Polyvalent metal salt C: calcium nitrate tetrahydrate (mol/kg) | 700 | 0 | 0 | 0 | 0.3 | 0 | 0 | 0 | 0 |
| Pigment PB 15:3 (solid content) | | 0 | 0 | 0 | 0 | 0 | 0 | 0 | 0 |
| Resin emulsion (solid content) | | 0 | 0 | 0 | 0 | 0 | 0 | 0 | 0 |
| Water | | Remainder | Remainder | Remainder | Remainder | Remainder | Remainder | Remainder | Remainder |
| Total | | 100 | 100 | 100 | 100 | 100 | 100 | 100 | 100 |

| | Maintenance liquid 4 | Maintenance liquid 5 | Maintenance liquid 6 | Maintenance liquid 7 | Maintenance liquid 8 | Maintenance liquid 9 | Ink 1 |
|---|---|---|---|---|---|---|---|
| 1,2-hexanediol (boiling point: 223° C.) | 4 | 0 | 0 | 0 | 29 | 0 | 5 |
| Propylene glycol (boiling point: 189° C.) | 50 | 0 | 0 | 0 | 0 | 29 | 10 |
| 1,3-butanediol (boiling point: 208° C.) | 0 | 0 | 0 | 0 | 0 | 0 | 0 |
| Propylene glycol monomethyl ether (boiling point: 121° C.) | 0 | 0 | 29 | 0 | 0 | 0 | 0 |
| Triethylene glycol monobutyl ether (boiling point: 272° C.) | 0 | 0 | 0 | 29 | 0 | 0 | 0 |
| Glycerine (boiling point: 290° C.) | 0 | 0 | 0 | 0 | 0 | 0 | 0 |
| Silicon-based surfactant BYK348 | 1 | 1 | 1 | 1 | 1 | 1 | 1 |

TABLE 1-continued

| | | | | | | | |
|---|---|---|---|---|---|---|---|
| Polyvalent metal salt A: calcium acetate monohydrate (mol/kg) | 0 | 0 | 0 | 0 | 0 | 0 | 0 |
| Polyvalent metal salt B: magnesium sulfate heptahydrate (mol/kg) | 0 | 0 | 0 | 0 | 0 | 0 | 0 |
| Polyvalent metal salt C: calcium nitrate tetrahydrate (mol/kg) | 0 | 0 | 0 | 0 | 0 | 0 | 0 |
| Pigment PB 15:3 (solid content) | 0 | 0 | 0 | 0 | 0 | 0 | 4 |
| Resin emulsion (solid content) | 0 | 0 | 0 | 0 | 0 | 0 | 3 |
| Water | Remainder | Remainder | Remainder | Remainder | Remainder | Remainder | Remainder |
| Total | 100 | 100 | 100 | 100 | 100 | 100 | 100 |

In Table 1, the described components, other than the compound name, are as follows.

Pigment: Cyan pigment (PB 15:3)

Silicone-based surfactant: Trade name "BYK-348", manufactured by BYK Additives & Instruments In addition, the solubility of the aggregating agent in water is calculated by adding an aggregating agent to 1 L of water at 20° C., stirring for 1 minute, carrying out the dissolving to a state without melting residue or turbidity, and confirming the maximum dissolved amount.

3.2. Recording Test

PET (a PET film "Lumirror S10" manufactured by Toray Industries, Inc.) was used as a recording medium, px-G930 (manufactured by Seiko Epson Corporation) was modified as a printer, and a configuration was adopted in which it is possible to supply a maintenance liquid as a moisturizing liquid to a cap covering the ink jet head and the bottom of the cap (in Example 13, the reaction solution was used as a maintenance liquid). In addition, means for spraying the maintenance liquid on the nozzle surface and wiping means (a wiper) were also attached thereto. One of the nozzle rows was filled with the reaction solution and a platen heater for primary heating was attached thereto. Furthermore, the recording medium discharged from the printer was secondarily heated in an oven. The primary heating was performed at a temperature of 40° C. except for Example 12 and at 35° C. in Example 12. The secondary heating was performed at 70° C. for 2 minutes.

3.3. Evaluation Test

Evaluation of Cleaning Recoverability after Moisturizing Step

After being left to stand with no cap at room temperature for 3 days, a moisturizing liquid was supplied to the cap under the conditions described in Tables 2 and 3, and a non-contact moisturizing step was performed. After that, suction cleaning was performed. 1 mL of reaction solution at a time was discharged from a head with 180 nozzles by suction, and then the presence or absence of a non-ejecting nozzle or a flying-deflection nozzle was evaluated based on the following evaluation criteria.

Evaluation Criteria

A: Nozzle recovery within 3 cleaning operations.

B: Nozzle recovery within 6 cleaning operations.

C: Nozzle recovery within 7 cleaning operations.

D: No nozzle recovery possible even with 7 cleaning operations.

Evaluation of Cleaning Recoverability after Spraying Step

As one set, printing was continuously performed for 10 hours, and then the maintenance liquid was sprayed onto the nozzle surface and wiped with a wiper, and evaluation was performed based on the following evaluation criteria.

Evaluation Criteria

A: Nozzle recovery within 3 sets.

B: Nozzle recovery within 6 sets.

C: Nozzle recovery within 7 sets.

D: No nozzle recovery possible even with 7 sets.

Recording Material Abrasion Resistance

The recorded matter obtained by the recording test described above was evaluated for abrasion resistance using a color fastness rubbing tester (apparatus name "AB-301", manufactured by Tester Sangyo Co., Ltd.). Specifically, the recording surface on which the image was recorded was rubbed 10 times forward and backward with a friction block to which a dried white cotton cloth (conforming to JIS L 0803) was attached with a load of 250 g. Then, the stains of the white cotton cloth and the degree of peeling of the image (coating film) were visually observed and evaluated based on the following evaluation criteria.

Evaluation Criteria

A: The white cotton cloth has no stain and no image peeling is observed.

B: Stains are observed in the white cotton cloth, but peeling of the image is not observed.

C: Image peeling occurred.

Odor

The odor of the recorded matter obtained by the recording test described above was directly sniffed, and sensory evaluation was performed based on the following evaluation criteria.

Evaluation Criteria

A: There was almost no smell.

B: There was an odor.

Moisture-Resistant Abrasion Resistance

The recorded matter obtained by the recording test described above was evaluated for abrasion resistance using a color fastness rubbing tester (apparatus name "AB-301", manufactured by Tester Sangyo Co., Ltd.). Specifically, the recording surface on which the image was recorded was rubbed 10 times forward and backward with a friction block to which a white cotton cloth (conforming to JIS L 0803) squeezed after immersion in water was attached with a load of 200 g. Then, the stains of the white cotton cloth and the degree of peeling of the image (coating film) were visually observed and evaluated based on the following evaluation criteria.

Evaluation Criteria

A: The white cotton cloth has no stain and no image peeling is observed.

B: Stains are observed in the white cotton cloth and peeling of the image is observed.

3.4. Evaluation Results

Examples 1 to 20 and Comparative Examples 1 to 5 were implemented based on the recording method and the evaluation tests described above, and the recording method and the evaluation results are summarized in the following Tables 2 and 3. For Examples 14 to 20 and Comparative Examples 4 and 5, only the cleaning recoverability was evaluated.

TABLE 2

| | Example 1 | Example 2 | Example 3 | Example 4 | Example 5 | Example 6 | Example 7 | Example 8 | Example 9 |
|---|---|---|---|---|---|---|---|---|---|
| Reaction solution | Reaction solution 1 | Reaction solution 2 | Reaction solution 3 | Reaction solution 4 | Reaction solution 5 | Reaction solution 2 | Reaction solution 2 | Reaction solution 2 | Reaction solution 2 |
| Maintenance liquid | Maintenance liquid 1 | Maintenance liquid 1 | Maintenance liquid 1 | Maintenance liquid 1 | Maintenance liquid 1 | Maintenance liquid 2 | Maintenance liquid 4 | Maintenance liquid 6 | Maintenance liquid 7 |
| Spraying amount of spraying step ($g/cm^2$) | 1 | 1 | 1 | 1 | 1 | 1 | 1 | 1 | 1 |
| Moisturizing liquid amount of moisturizing cap step ($g/cm^3$) | 1 | 1 | 1 | 1 | 1 | 1 | 1 | 1 | 1 |
| Standing time of moisturizing cap step (min) | 30 | 30 | 30 | 30 | 30 | 30 | 30 | 30 | 30 |
| Cleaning recoverability after spraying step | B | B | B | B | B | A | B | B | B |
| Cleaning recoverability after moisturizing step | B | B | B | B | B | A | B | C | C |
| Recorded matter abrasion resistance | A | A | B | A | C | A | A | A | A |
| Odor | B | A | B | A | B | A | A | A | A |
| Moisture-Resistant Abrasion Resistance | A | A | A | B | A | A | A | A | A |

| | Example 10 | Example 11 | Example 12 | Example 13 | Comparative Example 1 | Comparative Example 2 | Comparative Example 3 |
|---|---|---|---|---|---|---|---|
| Reaction solution | Reaction solution 2 | Reaction solution 2 | Reaction solution 2 | Reaction solution 2 | Reaction solution 2 | Reaction solution 2 | Reaction solution 5 |
| Maintenance liquid | Maintenance liquid 8 | Maintenance liquid 9 | Maintenance liquid 9 | Maintenance liquid 2 | Maintenance liquid 3 | Maintenance liquid 5 | Maintenance liquid 3 |
| Spraying amount of spraying step ($g/cm^2$) | 1 | 1 | 1 | 1 | 1 | 1 | 1 |
| Moisturizing liquid amount of moisturizing cap step ($g/cm^3$) | 1 | 1 | — | 1 | 1 | 1 | 1 |
| Standing time of moisturizing cap step (min) | 30 | 30 | — | 30 | 30 | 30 | 30 |
| Cleaning recoverability after spraying step | A | C | B | A | D | D | D |

TABLE 2-continued

| | | | | | | | |
|---|---|---|---|---|---|---|---|
| Cleaning recoverability after moisturizing step | A | B | — | A | D | D | B |
| Recorded matter abrasion resistance | A | A | B | A | A | A | C |
| Odor | A | A | A | A | A | A | B |
| Moisture-Resistant Abrasion Resistance | A | A | A | A | A | A | A |

TABLE 3

| | Example 14 | Example 15 | Example 16 | Example 17 | Example 18 | Example 19 | Example 20 | Comparative Example 4 | Comparative Example 5 |
|---|---|---|---|---|---|---|---|---|---|
| Reaction solution | Reaction solution 1 | Reaction solution 1 | Reaction solution 2 | Reaction solution 2 | Reaction solution 2 | Reaction solution 2 | Reaction solution 2 | Reaction solution 2 | Reaction solution 2 |
| Maintenance liquid | Maintenance liquid 6 | Maintenance liquid 9 | Maintenance liquid 6 | Maintenance liquid 1 | Maintenance liquid 1 | Maintenance liquid 1 | Maintenance liquid 9 | Maintenance liquid 5 | — |
| Spraying amount of spraying step ($g/cm^2$) | 1 | 1 | — | — | — | 1 | 2 | — | — |
| Moisturizing liquid amount of moisturizing cap step ($g/cm^3$) | 1 | 1 | 2 | 0.2 | 2 | 0.2 | — | 3 | — |
| Standing time of moisturizing cap step (min) | 30 | 30 | 30 | 30 | 30 | 30 | — | 30 | 30 |
| Cleaning recoverability after spraying step | B | B | — | — | — | — | B | — | D |
| Cleaning recoverability after moisturizing step | B | B | B | C | B | A | — | D | D |

As shown in Tables 2 and 3, in Comparative Example 5 in which neither humidification nor wiping was performed, ejection failures of the nozzle surface due to the reaction solution were observed.

In Examples 1 to 11, 13 to 15 and 19, and Comparative Examples 1 to 3, both humidification and wiping of the ink jet head were performed. In Comparative Examples 1 and 2, since the maintenance liquid did not include a water-soluble organic solvent having a boiling point of 280° C. or less, the results were that the ejection failures of the nozzle surface due to the reaction solution were not eliminated. In addition, in Comparative Example 3, since the reaction solution contains a high boiling point solvent having a boiling point of more than 280° C., the results were that water was not lost from the maintenance liquid and the evaluation of the cleaning recoverability after the moisturizing step was good; however, the evaluation of cleaning recoverability after the spraying step was low and the abrasion resistance of the recorded matter was inferior.

On the other hand, in Examples 1 to 15, the results were that both the cleaning recoverability evaluation after the spraying step and the cleaning recoverability evaluation after the moisturizing step were high, and ejection failures of the nozzle surface due to the reaction solution were eliminated. Note that, the reason why the evaluation of the recorded matter of Example 3 was low is considered to be because the amount of solvent in the reaction solution 3 was large. In addition, the reason why the evaluation of the recorded matter of Example 5 was low is considered to be because the reaction solution 5 contained a high boiling point solvent.

For Examples 12, 16 to 18, 20, and Comparative Example 4 in which either one of humidification or wiping of the ink jet head was performed, in Comparative Example 4, since the maintenance liquid did not include a water-soluble organic solvent having a boiling point of 280° C. or less, ejection failures of the nozzle surface due to the reaction solution were observed. On the other hand, in Examples 12, to 18, and 20, ejection failures of the nozzle surface were eliminated. Note that, in Example 16, since the amount of liquid used for moisturizing was low, the evaluation was lower than in the other examples. Note that, in Example 20, the reaction solution was also used as a maintenance liquid; however, since the reaction solution used included a water-soluble organic solvent having a boiling point of 280° C. or less and water, the cleaning recoverability was excellent in the same manner as the other Examples.

The invention is not limited to the embodiments described above, and various modifications are possible. For example, the invention includes configurations substantially the same as described in the embodiment (for example, configurations having the same functions, methods, and results, or configurations having the same object and effects). In addition, the invention includes configurations in which non-essential parts of the configuration described in the embodiments are replaced. Further, the invention includes configurations which achieve the same operations and effects as the configurations described in the embodiment, or configurations which are able to achieve the same object. Further, the invention includes configurations in which a well-known technique is added to the configurations described in the embodiments.

The entire disclosure of Japanese Patent Application No. 2016-079502, filed Apr. 12, 2016 is expressly incorporated by reference herein.

What is claimed is:

1. A method comprising:

ejecting a reaction solution from an ink jet head, the reaction solution including an aggregating agent for aggregating or thickening components of an ink composition; and attaching a maintenance liquid to a nozzle surface of an ink jet head to clean the nozzle surface, wherein the maintenance liquid includes a water-soluble organic solvent having a boiling point of 180° C. or higher and 280° C. or less and water.

2. The method according to claim 1, wherein the aggregating agent has a solubility in water of 200 g/l or more and 600 g/L or less.

3. The method according to claim 1, wherein at least one of alkanediol or alkylene glycol ether is provided as the water-soluble organic solvent.

4. The method according to claim 1, wherein at least one of alkanediol or alkylene glycol ether having 4 or more carbon atoms is provided as the water-soluble organic solvent.

5. The method according to claim 1, wherein the aggregating agent is at least one selected from the group consisting of a polyvalent metal salt, an organic acid, and a cationic compound.

6. The method according to claim 1, wherein content of the water-soluble organic solvent in the maintenance liquid is 3% by mass or more and 49% by mass or less.

7. The method according to claim 1, wherein a content of a water-soluble organic solvent having a normal boiling point of more than 280° C. in the maintenance liquid is 3% by mass or less.

8. The method according to claim 1, wherein a content of a water-soluble organic solvent having a normal boiling point of more than 280° C. in the ink composition is 3% by mass or less.

9. The method according to claim 1, wherein the reaction solution has a water content of 49% by mass or more.

10. The method according to claim 1, wherein an amount of the maintenance liquid supplied to the head moisturizing cap is 0.1 $g/cm^3$ or more.

11. The method according to claim 1, wherein moisturizing time for moisturizing the nozzle surface with the head moisturizing cap is 30 minutes or more.

12. The method according to claim 1, wherein a concentration of the aggregating agent in the reaction solution is 0.03 mol/kg or more and 1.5 mol/kg or less.

13. The method according to claim 1, wherein the method for maintaining an ink jet head is performed by an ink jet recording apparatus, and ejecting the reaction solution from the ink jet head and ejecting the ink composition from the ink jet head are performed in a state where a surface temperature of a recording medium is 45° C. or less.

14. The method according to claim 1, wherein a content of the water-soluble organic solvent in the maintenance liquid is 20% by mass or more and 24% by mass or less.

* * * * *